US011572654B2

(12) United States Patent
Kim et al.

(10) Patent No.: US 11,572,654 B2
(45) Date of Patent: Feb. 7, 2023

(54) CLOTHING TREATMENT APPARATUS

(71) Applicant: LG Electronics Inc., Seoul (KR)

(72) Inventors: Kihyuk Kim, Seoul (KR); Jaeil Bae, Seoul (KR); Seonkyu Kim, Seoul (KR); Wookjun Chung, Seoul (KR); Jaehyung Kim, Seoul (KR); Semin Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 57 days.

(21) Appl. No.: 17/044,064

(22) PCT Filed: Apr. 3, 2019

(86) PCT No.: PCT/KR2019/003927

§ 371 (c)(1),
(2) Date: Sep. 30, 2020

(87) PCT Pub. No.: WO2019/194567

PCT Pub. Date: Oct. 10, 2019

(65) Prior Publication Data

US 2021/0140095 A1 May 13, 2021

Related U.S. Application Data

(60) Provisional application No. 62/679,035, filed on Jun. 1, 2018.

(30) Foreign Application Priority Data

Apr. 3, 2018 (KR) ..... 10-2018-0038425
Jun. 28, 2018 (KR) ..... 10-2018-0074728
Apr. 3, 2019 (KR) ..... 10-2019-0038797

(51) Int. Cl.
*D06F 71/34* (2006.01)
*D06F 58/10* (2006.01)
(Continued)

(52) U.S. Cl.
CPC ..... *D06F 71/34* (2013.01); *D06F 58/10* (2013.01); *D06F 58/203* (2013.01); *D06F 71/36* (2013.01)

(58) Field of Classification Search
CPC ..... D06F 73/02; D06F 71/34; D06F 58/203; D06F 58/10; D06F 71/36
See application file for complete search history.

(56) References Cited

U.S. PATENT DOCUMENTS 3,203,122 A 8/1965 Sweatt
4,694,146 A 9/1987 DeMars
(Continued)

FOREIGN PATENT DOCUMENTS

CN 1170061 1/1998
CN 1545392 11/2004
(Continued)

OTHER PUBLICATIONS

PCT International Search Report and Written Opinion in International Application No. PCT/KR2019/003927, dated Jul. 29, 2019, 7 pages (with English translation).
(Continued)

*Primary Examiner* — Benjamin L Osterhout
(74) *Attorney, Agent, or Firm* — Fish & Richardson P.C.

(57) ABSTRACT

The present invention relates to a clothing treatment apparatus. The clothing treatment apparatus comprises: a cabinet; a first clothing treatment chamber for accommodating clothes in the cabinet; a machine chamber for supplying steam or air to the first clothing treatment chamber; and a door assembly for opening and closing an opening. The door assembly comprises: a first panel having a second clothing treatment chamber for treating clothes formed therein, the first panel being open at one side and being pivotably connected to the cabinet; a second panel for opening and
(Continued)

closing the open one side of the first panel; and a partition plate, disposed between the first panel and the second panel, for applying pressure to each of the clothes placed on the first panel and the clothes placed on the second panel.

19 Claims, 19 Drawing Sheets

(51) Int. Cl.
*D06F 71/36* (2006.01)
*D06F 58/20* (2006.01)

(56) References Cited

U.S. PATENT DOCUMENTS

| | | | | |
|---|---|---|---|---|
| 9,708,753 | B2 * | 7/2017 | Yoo | D06F 81/02 |
| 2004/0237356 | A1 | 12/2004 | Khasianovich | |
| 2010/0299976 | A1 * | 12/2010 | Roselle | D06F 58/10 38/1 A |
| 2012/0018461 | A1 | 1/2012 | Azizian et al. | |
| 2012/0285037 | A1 * | 11/2012 | Park | D06F 58/38 34/474 |
| 2015/0020419 | A1 | 1/2015 | Park et al. | |
| 2016/0175471 | A1 * | 6/2016 | Choi | D06F 73/02 239/58 |
| 2016/0208429 | A1 | 7/2016 | Park et al. | |

FOREIGN PATENT DOCUMENTS

| | | |
|---|---|---|
| CN | 104294529 | 1/2015 |
| CN | 105714543 | 6/2016 |
| CN | 206233008 | 6/2017 |
| EP | 0816552 | 1/1998 |
| EP | 2826911 | 1/2015 |
| JP | S4734352 Y1 | 10/1972 |
| JP | S541527 U | 1/1979 |
| JP | 5865200 | 4/1983 |
| JP | 5881098 | 5/1983 |
| JP | 2005329104 | 12/2005 |
| JP | 2013103136 | 5/2013 |
| KR | 20010113436 | 12/2001 |
| KR | 20080001854 | 1/2008 |
| KR | 1020090069755 | 7/2009 |
| KR | 20110048343 | 5/2011 |
| KR | 20110048344 | 5/2011 |
| KR | 1020150009718 | 1/2015 |
| KR | 1020150065297 | 6/2015 |
| KR | 1020160075032 | 6/2016 |
| RU | 2576509 | 3/2016 |

OTHER PUBLICATIONS

RU Notice of Allowance in Russian Appln. No. 2020133090, dated Mar. 4, 2021, 21 pages (with English translation).
Office Action in Australian Appln. No. 2019249762, dated Jun. 25, 2021, 11 pages.
Extended European Search Report in European Appln. No. 19780549.2, dated Jan. 10, 2022, 10 pages.
Office Action in Japanese Appln. No. 2020-553648, dated Nov. 2, 2021, 6 pages (with English translation).
Office Action in Korean Appln. No. 10-2021-0100021, dated Nov. 18, 2021, 18 pages (with English translation).
Office Action in Chinese Appln. No. 201980023942.2, dated May 18, 2022, 17 pages (with English translation).

* cited by examiner (a)

(b)

CLOTHING TREATMENT APPARATUS

CROSS-REFERENCE TO RELATED APPLICATIONS

This application is a National Stage application under 35 U.S.C. § 371 of International Application No. PCT/KR2019/003927, filed on Apr. 3, 2019, which claims the benefit of Korean Application No. 10-2019-0038797, filed on Apr. 3, 2019, Korean Application No. 10-2018-0074728, filed on Jun. 28, 2018, U.S. Provisional Application No. 62/679,035, filed on Jun. 1, 2018, and Korean Application No. 10-2018-0038425, filed on Apr. 3, 2018. The disclosures of the prior applications are incorporated by reference in their entirety.

TECHNICAL FIELD

The present disclosure relates to a laundry treating apparatus, and more particularly, to a laundry treating apparatus that may press laundry such as at least two or more pants or use steam and a heating wire to remove wrinkles thereof.

BACKGROUND ART

In general, a laundry treating apparatus is configured to perform various laundry-related treatments (washing, drying, deodorization, wrinkle removal, etc.) and may include a washing apparatus for washing laundry, a dryer for drying laundry, a combined drying and washing machine for washing and drying functions, a drying apparatus for drying wet laundry, a refresher for removing odors from laundry or wrinkles therefrom, a steamer to remove unnecessary wrinkles, etc.

A refresher is an apparatus for making a state of laundry pleasant and fresh, and performs functions such as drying laundry, supplying fragrance to laundry, preventing static electricity from occurring in laundry, or removing wrinkles from laundry.

Further, the laundry treating apparatus is in the trend of being developed so that washing, drying, deodorization and wrinkle removal of laundry may be solved with one apparatus. However, because the laundry treating apparatus uses a drum in which laundry is accommodated and a driving device for rotating the drum, deodorization or wrinkle removal of laundry is insufficient.

In order to solve this problem, a laundry treating apparatus having a steamer and a refresher is disclosed in Korean Patent Application Publication No. 10-2014-0184457. The laundry treating apparatus has a treating chamber that treats laundry with air circulation or steam, and a separate wrinkle removal module that removes wrinkles by pressing laundry inside the treating chamber. The laundry treating apparatus as described above discloses a structure in which the wrinkle removal module that removes wrinkles by pressing laundry may treat only singe laundry. In this case, when it is necessary to treat a plurality of pants to be treated, there is a problem that it takes a lot of time as the module has to treat the plurality of pants sequentially one by one.

Further, referring to FIG. 1, a conventional laundry treating apparatus includes a cabinet 10 forming an exterior appearance, a first laundry treating chamber 11 providing a receiving space 14 for accommodating laundry therein, a door for opening and closing the cabinet, hangers 51 and 52 disposed at the door or in the first laundry treating chamber 11 to hold laundry, and a machine chamber 20 supplying hot-air or moisture to the first laundry treating chamber 11.

An auxiliary hanger 50 for fixing the laundry, and a presser 60 disposed under the auxiliary hangers to press the laundry are provided inside the door. The auxiliary hanger 50 includes a hanger 522, and a hanger support 521 disposed on the door and supporting the hanger 522 thereon. The presser 60 includes a support 65 that supports the laundry at one face thereof, a pressing portion 66 that is pivotably configured and moves toward the support 65 and presses the other face of the laundry, and an anti-torsion portion 67 disposed under the pressing portion 66 to prevent torsion of the laundry.

As a result, the laundry treating apparatus is able to remove wrinkles and perform deodorizing at the same time by supplying hot-air from the machine chamber located under the cabinet to the laundry or pressing the laundry in a state when the laundry is disposed in the receiving space 14.

Further, in the laundry treating apparatus, hot-air or moisture is supplied to the laundry while the laundry is unfolded by its own weight and inside the cabinet, so that drying and deodorization or wrinkle removal of the laundry may be achieved. Further, when the pressing portion 66 presses the face of the laundry, the wrinkles of the laundry may be effectively removed, or creases (wrinkles intentionally formed in the laundry) may be formed, and thus ironing may be omitted after washing or drying is completed.

However, in the conventional the laundry treating apparatus, there is no separate member between the pressing portion 66 and the support 65. Thus, there is a problem that only one laundry is pressed, thereby reducing efficiency.

Further, in the conventional laundry treating apparatus, the pressing portion 65 is pressed toward a side of the laundry P while being pivoted, so that the pressing portion 65 sequentially presses the laundry from one side of the laundry P to the other side thereof.

Thus, a relatively large amount of pressure is applied to a portion of the laundry P close to the pressing portion 65, while a relatively small amount of pressure is applied to a portion of the laundry far away from the pressing portion 65. Thus, there is a problem in that the laundry is not pressed evenly.

Furthermore, in the process of the pressing portion 65 pressing the laundry P, there is a problem in that the laundry P is distorted or displaced due to being pushed by the pressing portion 65.

Further, the conventional the laundry treating apparatus has a problem in that the laundry cannot be fixed even when the laundry P is held on a laundry hanger, and thus the position of the laundry is changed when the laundry is pressed. As a result, in the conventional laundry treating apparatus, the pressing portion 65 causes more wrinkles in the laundry P, or causes creases to be formed in a direction completely different from the intended direction.

Further, the conventional laundry treating apparatus has a problem in that when the laundry is a lower garment such as pants and thus has regions partitioned from each other, the pressing portion may not press each of the partitioned regions in an individual manner. For example, in the conventional the laundry treating apparatus, when the laundry is a lower garment such as pants, a first portion of the laundry corresponding to a left leg and a second portion thereof corresponding to a right leg are pressed in an overlapped manner.

Therefore, there is a problem that in the process of pressing the laundry, the first portion and the second portion overlap each other in a non-matching manner or creases occur in an unintended area of the laundry due to the displacement of the laundry.

Further, there is a problem in that refreshing as drying and deodorization is not performed reliably because hot-air or moisture steam is not supplied into a region in which the first portion and the second portion contact each other.

SUMMARY

A first purpose of the present disclosure is to provide a laundry treating apparatus that treats a plurality of garments whose wrinkles must be removed via pressing in a short time.

A second purpose of the present disclosure is to provide a laundry treating apparatus capable of treating a single garment or a plurality of garments at the same performance even when the single garment or the plurality of garments is simultaneously pressed and treated.

A third purpose of the present disclosure is to provide a laundry treating apparatus that removes wrinkles by pressurizing a plurality of garments while the plurality of garments placed inside a cabinet is being treated.

A fourth purpose of the present disclosure is to provide a laundry treating apparatus that may evenly press partitioned areas of laundry such as a lower garment having the partitioned areas.

A fifth purpose of the present disclosure is to provide a laundry treating apparatus that may evenly supply at least one of steam or hot-air to partitioned areas of laundry.

A sixth purpose of the present disclosure is to provide a laundry treating apparatus that may prevent a position of laundry from being changed in a process of pressing the laundry.

A seventh purpose of the present disclosure is to provide a laundry treating apparatus by which a crease may be accurately formed in an area intended by a user.

The purposes of the present disclosure are not limited to the purposes mentioned above, and other purposes that are not mentioned will be clearly understood by those skilled in the art from the following description.

Technical Solutions

In order to achieve the above purposes, a laundry treating apparatus according to the present disclosure includes a cabinet having a front opening; a door assembly for opening and closing the opening; a first laundry treating chamber defined in the cabinet to receive laundry therein, wherein the first laundry treating chamber communicates with an outside of the cabinet through the opening; and a machine chamber in communication with the first laundry treating chamber, wherein the machine chamber receives therein at least one of a steam supply to supply steam to the first laundry treating chamber and an air supply for circulating air, wherein the door assembly includes: a first panel having a second laundry treating chamber defined therein to treat laundry therein, wherein one face of the first panel is open and the first panel is pivotably connected to the cabinet; a second panel pivotably connected to the first panel for opening and closing the open one face of the first panel; and a partitioning plate disposed between the first panel and the second panel to press each of first laundry held on the first panel and second laundry held on the second panel. Thus, at least two garments may be treated in the door assembly at the same time.

In order to achieve the first purpose, one side of the partitioning plate is hinge-coupled to one side of the first panel or the second panel, wherein the other side of the partitioning plate is removably coupled to the other side of the first panel or the second panel. Thus, at least two garments may be held in the door assembly.

In order to achieve the first purpose, the partitioning plate includes a fixing protrusion to fixe or separate the partitioning plate to or from one side of the first panel or one side of the second panel. Thus, at least two garments may be treated in the door assembly.

In order to achieve the first and second purposes, when the partitioning plate is fixed to the first panel or the second panel, a spacing between the partitioning plate and the first panel or the second panel is kept to be constant. Thus, even when a single garment is held in the door assembly, the garment may be uniformly pressed.

In order to achieve the first and second purposes, when the first panel is fixed to the second panel, each of a spacing between the first panel and the partitioning plate and a spacing between the partitioning plate and the second panel is kept to be constant. Thus, each of at least two garments may be uniformly pressed.

A first fixing member for fixing laundry thereto, and a first base plate in close contact with the partitioning plate to press the laundry fixed to the first fixing member are disposed on an inner face of the first panel, wherein a second fixing member for fixing laundry thereto, and a second base plate in close contact with the partitioning plate to press the laundry fixed to the second fixing member are disposed on an inner face of the second panel. Thus, a plurality of garments may be held in the door assembly.

The second panel is disposed between the first laundry treating chamber and the second laundry treating chamber. A communication hole for communicating the first laundry treating chamber and the second laundry treating chamber with each other is defined in the second panel. Thus, the laundry in the second chamber may be treated using air or steam flowing in the first chamber.

The partitioning plate has a rectangular plate shape, and has an opening defined in a center thereof and extending in a front and rear direction. Thus, the steam in the second chamber may flow through the partitioning plate.

The machine chamber receives therein: a first laundry treating chamber supply pipe to circulate air in the first laundry treating chamber or to supply steam generated from a steam generator to the first laundry treating chamber; and a second laundry treating chamber supply pipe to supply steam generated from the steam generator to the second laundry treating chamber. Thus, separate steam may be fed to the second chamber.

The second laundry treating chamber supply pipe is a pipe branched from a downstream portion of the first laundry treating chamber supply pipe. Thus, a structure of the existing machine chamber may be used.

An adjustment cover configured for controlling steam supply to the second laundry treating chamber supply pipe is disposed at one side of the first laundry treating chamber supply pipe at which the second laundry treating chamber supply pipe is connected to the first laundry treating chamber supply pipe. Thus, the steam supply to the second chamber may be controlled.

A second laundry treating chamber supply hole is defined in a top of the machine chamber to supply steam flowing in the second laundry treating chamber supply pipe to the door assembly. Thus, the steam may be fed to the second chamber.

The door assembly has a door inflow hole defined therein for supplying steam discharged from the second laundry treating chamber supply hole to the second laundry treating chamber. Thus, the steam from the machine chamber may be supplied to the door assembly.

A door inflow hole through which steam flowing through the second laundry treating chamber supply hole flows into the second laundry treating chamber is defined in a bottom of the second panel, wherein a door discharge hole through which steam flowing through the second laundry treating chamber is exhausted to the first laundry treating chamber is defined in a top of the second panel. Thus, the steam may be fed to the second chamber or may be discharged out of the second chamber.

A door inflow hole-gasket is disposed on the second panel, wherein when the door assembly closes the cabinet, the door inflow hole-gasket seals a space between the door inflow hole and the second laundry treating chamber supply hole. Thus, the steam may be stably fed to the second chamber.

In order to achieve the third purpose, the second panel pivots in a front direction of the door assembly. Thus, the second chamber may be used in a separate manner from the first chamber.

The apparatus according to the present disclosure further comprises: a cabinet hinge pivotably connecting the door assembly to the cabinet; an assembly hinge pivotably connecting the second panel to the first panel; and a steam supply for supplying steam generated from the steam generator to the second laundry treating chamber through the cabinet hinge and the assembly hinge. Thus, the steam may be stably fed to the door assembly.

The apparatus according to the present disclosure further comprises a connection pipe disposed inside the door assembly to connect the cabinet hinge and the assembly hinge to each other. Thus, the steam may be stably fed to the door assembly.

In another embodiment of the present disclosure, the door assembly is free of the first and second panels but includes an ironing presser. The ironing presser includes a support body disposed on one of the first laundry treating chamber and the door assembly to support laundry thereon; a pressing body configured to be pivotably moved toward the support body to press the laundry on the support body; and an ironing partitioning portion disposed between the support body and the pressing body and configured to be pivotably moved toward the support body or the pressing body such that both opposing faces of the ironing partitioning portion press the laundry.

Alternatively, the door assembly may include a support body disposed on the inner face of the door assembly to support laundry thereon; a pressing body configured to be pivotably moved toward the support body to press the laundry on the support body; and an ironing partitioning portion disposed between the support body and the pressing body and configured to be pivotably moved toward the support body or the pressing body such that both opposing faces of the ironing partitioning portion press the laundry.

The ironing partitioning portion includes: an ironing partitioning body disposed between the support body and the pressing body and configured to be pivotably moved toward the support body or the pressing body; and a heater disposed on at least one of both opposing faces of the ironing partitioning body and configured to supply heat to the laundry.

Further, the heater includes: a heating body disposed on at least one of the both opposing faces of the ironing partitioning body and exposed to an outside; and a heating wire disposed in one of the ironing partitioning body and the heating body and configured to heat the heating body.

Alternatively, the heater includes: a heating body disposed on at least one of the both opposing faces of the ironing partitioning body and exposed to an outside; a steam supply channel defined in one of the ironing partitioning body and the heating body to receive steam; and a plurality of discharge holes passing through the heating body and discharging the steam to the laundry.

Further, the steam supply channel further includes at least one spray channel extending along a height direction of the ironing partitioning body, wherein the plurality of discharge holes are arranged in a longitudinal direction of the spray channel.

Particularly, the apparatus according to the present disclosure further comprises an auxiliary steam supply for generating steam, wherein the auxiliary steam supply is disposed in one of the cabinet, the machine chamber, and the door assembly, wherein the steam supply channel communicates the auxiliary steam supply and the discharge hole with each other.

The auxiliary steam supply includes: an auxiliary water tank detachably disposed in at least one of the cabinet, the machine chamber, and the door assembly to receive water therein; an auxiliary heater for heating water in the auxiliary water tank to generate steam; and a discharge hole communicating the water tank and the supply channel with each other and discharging the steam.

Further, the ironing partitioning portion includes: a heating body disposed on at least one of the both opposing faces of the ironing partitioning body and exposed to an outside; a heating wire disposed in one of the ironing partitioning body and the heating body and configured to heat the heating body; and a supply channel defined in one of the ironing partitioning body and the heating body and receiving steam, wherein the heating wire extends to surround an outer periphery of the supply channel such that the heating wire does not interfere with the supply channel.

Further, the door assembly further includes: a connection hinge pivotably coupling the ironing partitioning portion and the support body to each other; and a passage defined in the connection hinge, wherein the heating wire or the supply channel passes through the passage.

Further, the ironing partitioning portion is configured to communicate with the machine chamber, and thus, to discharge hot-air or moisture supplied from the machine chamber.

Further, the door assembly further includes: a coupling hook disposed on the support body to fix the pressing body to the support body; and a hook coupler disposed on the pressing body and coupled to the coupling hook, wherein a coupling between the coupling hook and the hook coupler allows the support body and the pressing body to be prevented from being separated from the ironing partitioning portion.

Moreover, the apparatus according to the present disclosure further comprises a laundry hanger disposed above and/or below the ironing partitioning portion to hold the laundry.

In this case, the laundry hanger includes: a hanger body disposed above and/or below the ironing partitioning portion and configured to be pivotably moved to hold laundry; and a fixing body coupled to the hanger body to fix the laundry to the hanger body.

More specifically, the laundry hanger includes: a first laundry hanger disposed above the pressing body and configured to be pivotably moved to hold the laundry; and a second laundry hanger disposed below the pressing body and configured to be pivotably moved to hold the laundry, wherein the first laundry hanger includes: a first hanger body disposed above the pressing portion and configured to be pivotably moved to hold laundry; and a first fixing body coupled to the first hanger body to fix the laundry to the first hanger body, wherein the second laundry hanger includes: a second hanger body disposed below the pressing portion and configured to be pivotably moved to hold laundry; and a second fixing body coupled to the second hanger body to fix the laundry to the second hanger body.

Further, the second hanger body has a first through-slit defined therein through which a first portion of the laundry passes, wherein the second fixing body has a second through-slit defined therein through which a second portion of the laundry passes. The first hanger body has a receiving groove defined therein and having one curved face and receiving and supporting therein a portion of the laundry.

Further, the door assembly further includes: a first ironing partitioning portion including: a first ironing partitioning body pivotably disposed between the first panel and the partitioning plate; and a first heater disposed on at least one of both opposing faces of the first ironing partitioning body to apply heat to the laundry; and a second ironing partitioning portion including: a second ironing partitioning body pivotably disposed between the partitioning plate and the second panel; and a second heater disposed on at least one of both opposing faces of the second ironing partitioning body to apply heat to the laundry.

Accordingly, one ironing partitioning portion may be inserted between the first panel and the partitioning plate, and another ironing partitioning portion may be inserted between the partitioning plate and the second panel of the door assembly. That is, there are a total of two ironing partitioning portions which are referred to as the first ironing partitioning portion and the second ironing partitioning portion, respectively. As in the ironing partitioning portion, first and second heaters and first and second ironing partitioning bodies are present.

Thus, the first heater includes: a first heating body disposed on at least one of the both opposing faces of the first ironing partitioning body and exposed to an outside; and a first heating wire disposed in one of the first ironing partitioning body and the first heating body and configured to heat the first heating body, wherein the second heater includes: a second heating body disposed on at least one of the both opposing faces of the second ironing partitioning body and exposed to an outside; and a second heating wire disposed in one of the second ironing partitioning body and the second heating body and configured to heat the second heating body.

Further, the first heater includes: a first heating body disposed on at least one of the both opposing faces of the first ironing partitioning body and exposed to an outside; a first steam supply channel defined in one of the first ironing partitioning body and the first heating body to receive steam; and a plurality of first discharge holes passing through the first heating body and discharging the steam to the laundry, wherein the second heater includes: a second heating body disposed on at least one of the both opposing faces of the second ironing partitioning body and exposed to an outside; a second steam supply channel defined in one of the second ironing partitioning body and the second heating body to receive steam; and a plurality of second discharge holes passing through the second heating body and discharging the steam to the laundry.

Further, each of the first heater and the second heater may have the ironing partitioning body, the heating body, the heating wire, the supply channel, and the discharge hole and may simultaneously perform the heating and steam discharge.

Further, the first supply channel and the second supply channel further respectively include at least one first spray channel and at least one second spray channel extending along height directions of the first ironing partitioning body and the second ironing partitioning body, respectively, wherein the first discharge holes are arranged in a longitudinal direction of the first spray channel, and the second discharge holes are arranged in a longitudinal direction of the second spray channel.

Further, the apparatus according to the present disclosure further comprises an auxiliary steam supply for generating steam, wherein the auxiliary steam supply is disposed in one of the cabinet, the machine chamber, and the door assembly, wherein the supply channel is configured to communicate with the auxiliary steam supply, the first discharge holes and the second discharge holes.

The apparatus according to the present disclosure further comprises a laundry hanger for holding laundry, wherein the laundry hanger is disposed above and/or below the first base plate, the second base plate, the partitioning plate, the first ironing partitioning body, and the second ironing partitioning body.

Specifically, the laundry hanger includes: a hanger body disposed above and/or below the first base plate, the second base plate, the partitioning plate, the first ironing partitioning body, and the second ironing partitioning body and configured to be pivotably moved to hold laundry; and a fixing body coupled to the hanger body for fixing the laundry to the hanger body.

Further, the laundry hanger includes first and second laundry hangers, wherein the first laundry hanger includes: a first hanger body disposed above the first ironing partitioning portion and configured to be pivotably moved to hold laundry; a first fixing body coupled to the first hanger body for fixing the laundry to the first hanger body; a second hanger body disposed above the second ironing partitioning portion and configured to be pivotably moved to hold laundry; and a second fixing body coupled to the second hanger body for fixing the laundry to the second hanger body, wherein the second laundry hanger includes: a third hanger body disposed below the first ironing partitioning portion and configured to be pivotably moved to hold laundry; a third fixing body coupled to the third hanger body for fixing the laundry to the third hanger body; a fourth hanger body disposed below the second ironing partitioning portion and configured to be pivotably moved to hold laundry; and a fourth fixing body coupled to the fourth hanger body for fixing the laundry to the fourth hanger body.

Details of other embodiments are included in the detailed description and drawings.

Advantageous Effects

The laundry treating apparatus according to the present disclosure has one or more of following effects.

First, the laundry treating apparatus according to the present disclosure has an advantage of pressing two or more pieces of laundry held inside the door assembly at once to remove wrinkles therefrom, thereby shortening the time required for laundry treatment.

Second, in the laundry treating apparatus according to the present disclosure, even when a single garment is held inside the door assembly or two or more garments are held therein, the two or more garments may be pressed at a uniform performance level.

Third, in the laundry treating apparatus according to the present disclosure, the second laundry treating chamber is opened toward a front direction of the door, so that first laundry is held and treated in the second laundry treating chamber while second laundry is being treated in the first laundry treating chamber inside the cabinet.

Fourth, the laundry treating apparatus according to the present disclosure may evenly press partitioned areas of laundry such as a lower garment having the partitioned areas.

Fifth, the laundry treating apparatus according to the present disclosure may evenly supply at least one of steam or hot-air to partitioned areas of laundry.

Sixth, the laundry treating apparatus according to the present disclosure may press a plurality of garments at once.

Seventh, the laundry treating apparatus according to the present disclosure may prevent a position of laundry from being changed during the process of pressing the laundry.

Eighth, the laundry treating apparatus according to the present disclosure may allow the user to omit separate ironing after the refreshing such as drying and deodorization of laundry is completed.

Ninth, the laundry treating apparatus according to the present disclosure may accurately form the crease in the area intended by the user.

Tenth, the laundry treating apparatus according to the present disclosure may be effective in removing wrinkles by heating and pressing, at once, two or more garments via concurrent heating of and steam supply to the garments using the heating wire and the steam channel.

The effects of the present disclosure are not limited to the above-mentioned effects, and other effects that are not mentioned will be clearly understood by those skilled in the art from the description of the claims.

DETAILED DESCRIPTION

Figure 1:
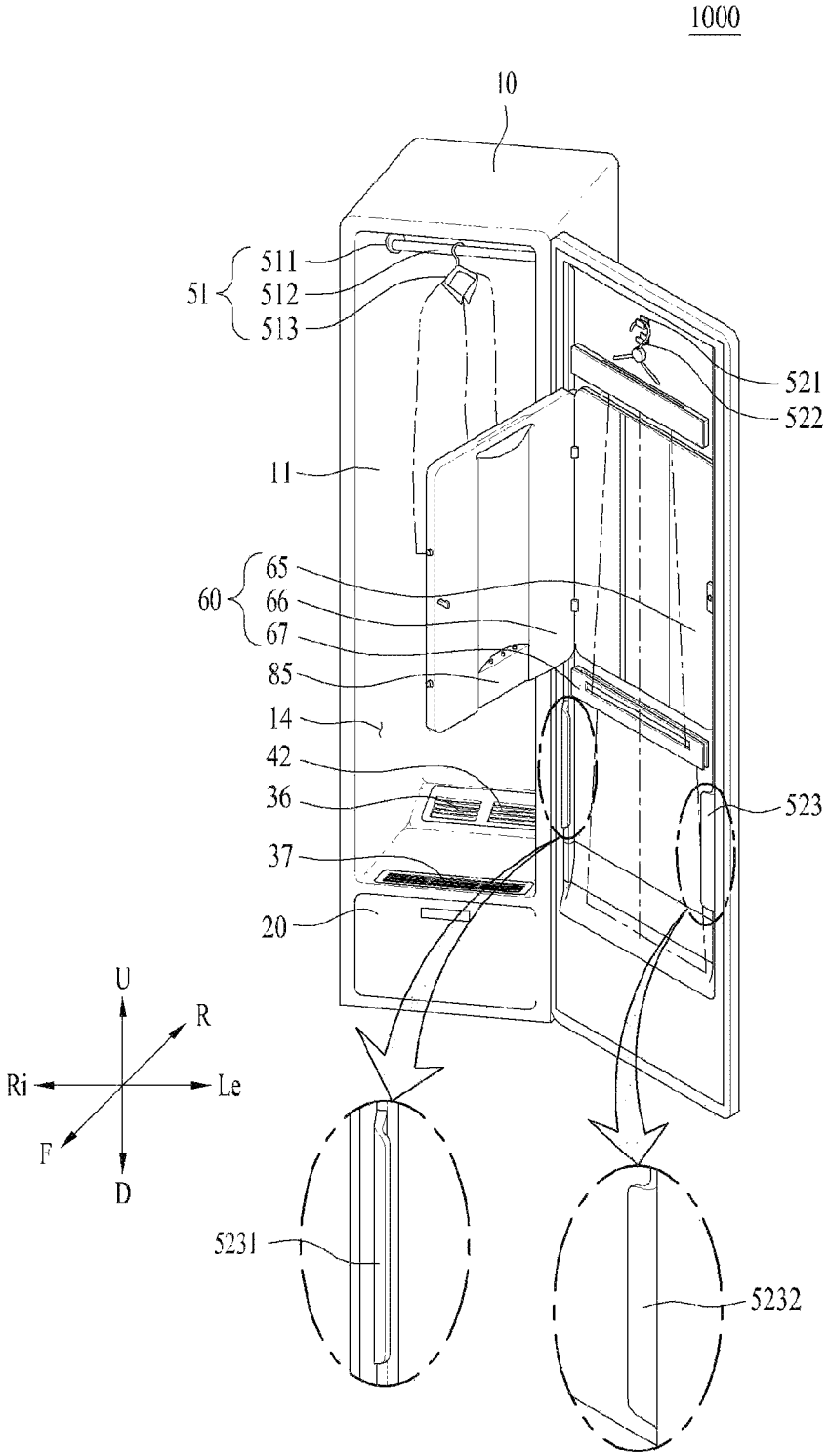
FIG. 1 shows a structure of a conventional laundry treating apparatus.

Advantages and features of the present disclosure, and a method of achieving them will become apparent with reference to embodiments as described below in detail with the accompanying drawings. However, the present disclosure is not limited to the embodiments disclosed below, but may be implemented in a variety of different forms. Only these embodiments are provided to allow the present disclosure to be complete, and to completely inform those of ordinary skill in the technical field to which the present disclosure belongs of the scope of the present disclosure. The present disclosure is only defined by a scope of the claims. The same reference numerals refer to the same components throughout the specification.

Expressions referring to directions such as "front (F)/rear (R)/left (Le)/right (Ri)/upper (U)/down (D)" are defined as indicated in the drawings. However, this may merely ensure that the present disclosure is clearly understood. In another example, each of the directions may be defined in a manner different from a manner as indicated in the drawings based on a reference position.

Further, herein, in various embodiments, the same and similar reference numbers are allocated to the same and similar components, and descriptions thereof in a previous drawing is equally applied to descriptions thereof in a subsequent drawing. A singular expression of a component used in the present specification includes a plural expression thereof unless clearly mentioned otherwise in a context. Further, in describing the embodiment disclosed in the present specification, when it is determined that a detailed description of a related known component may obscure gist of the embodiment disclosed in the present specification, the detailed description thereof will be omitted. Further, it should be noted that the accompanying drawings are set forth for easy understanding of the embodiments disclosed in the present specification, and a technical spirit disclosed in the present specification is not limited to the accompanying drawings.

Hereinafter, embodiments disclosed in the present specification will be described in detail with reference to the accompanying drawings.

Figure 2:
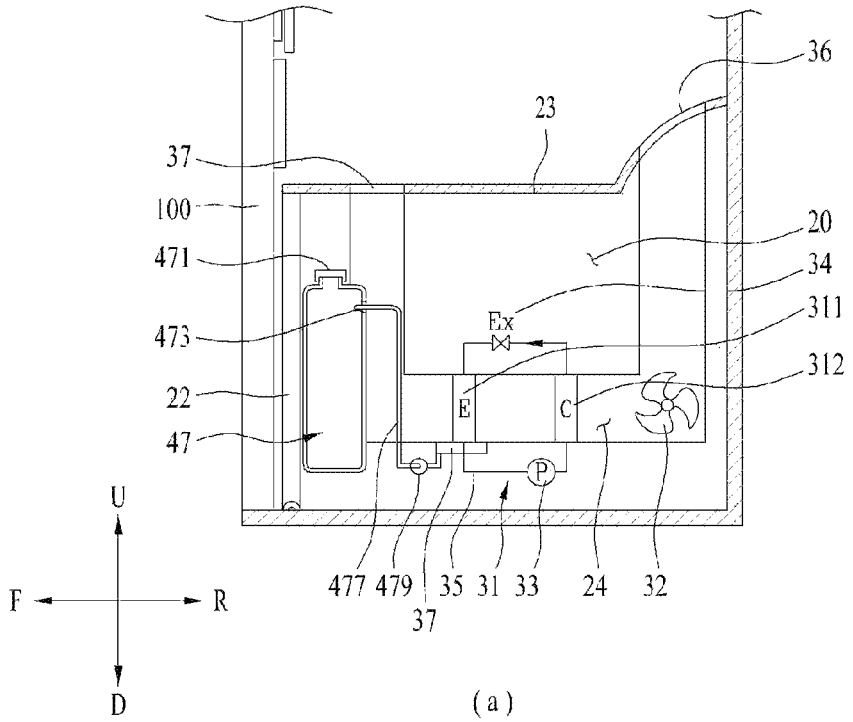
FIG. 2 shows an arrangement structure of a machine chamber.
Figure 2:
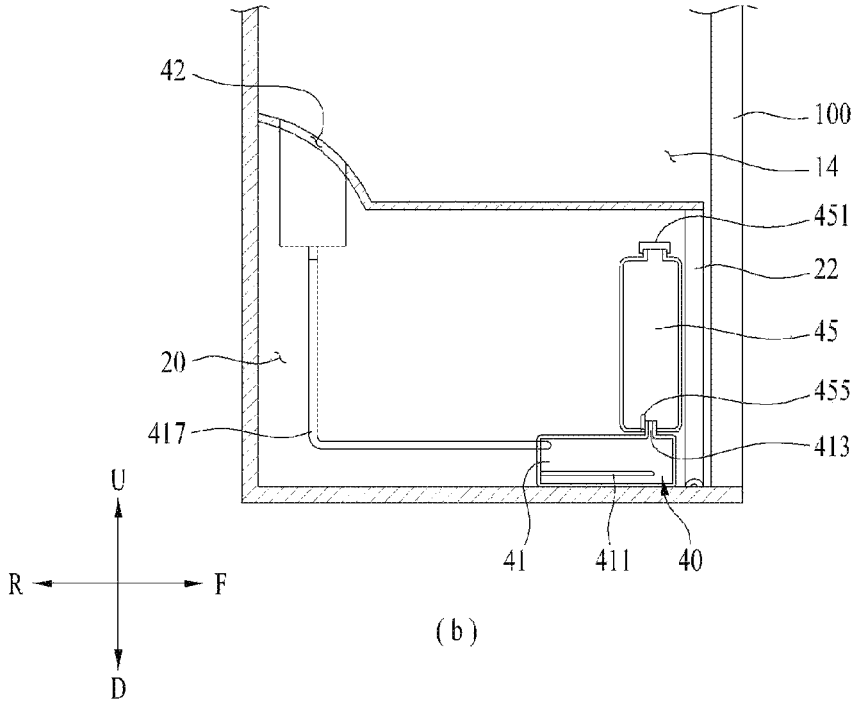

FIG. 2 describes a structure of a machine chamber 20 of a laundry treating apparatus 1000 according to the present disclosure.

The machine chamber 20 may include at least one of an air supply 30 supplying air (heated air or non-heated air) to a receiving space 14 of a first laundry treating chamber 11 and a steam supply 40 supplying moisture (steam or mist) to the receiving space 14.

To this end, the first laundry treating chamber 11 has an air outlet 36 defined therein that discharges air to the machine chamber 20, and an air inlet 37 defined therein that receives air from the machine chamber 20, and a steam supply hole 42 defined therein for receiving moisture or steam from the machine chamber 20.

Because the machine chamber 20 generates hot-air having a relatively lower density than that of air, the machine chamber 20 may be disposed under the first laundry treating chamber 11 so that the hot-air may be completely supplied to the receiving space 14.

The machine chamber 20 may include at least one of the air supply 30 supplying air (heated air or non-heated air) to the receiving space 14, and the steam supply 40 supplying moisture (steam or mist) to the receiving space 14.

Hereinafter, for convenience of description, an example in which the machine chamber includes both the air supply 30 and the moisture supply 40, the air supply 30 supplies hot-air to the receiving space 14 and the steam supply 40 supplies steam to the receiving space 14 will be described.

The air supply 30 may include a first laundry treating chamber supply pipe 24, which circulates air inside the receiving space 14, a heat-exchanger 31 which exchanges heat with air flowing along the first laundry treating chamber supply pipe 24, and a blowing fan 32 to allow air inside the receiving space 14 to flow along the first laundry treating chamber supply pipe 24.

The first laundry treating chamber supply pipe 24 communicates with an interior of the receiving space 14 through the air outlet 36 and the air inlet 37 disposed in the receiving space 14.

The air outlet 36 and the air inlet 37 may pass through a bottom face of the receiving space 14 and communicate the receiving space 14 and the machine chamber 20. Therefore, when one end of the first laundry treating chamber supply pipe 24 placed inside the machine chamber 20 is connected to the air inlet 37 and the other end thereof is connected to the air outlet 36, the first laundry treating chamber supply pipe 24 is able to communicate with the interior of the receiving space 14.

The heat-exchanger 31 refers to means for dehumidifying and heating air introduced into the first laundry treating chamber supply pipe 24. (a) in FIG. 2 shows a heat pump as an embodiment of the heat-exchanger.

When the heat-exchanger is embodied as the heat pump, the heat-exchanger 31 may include an evaporator (E, 311) disposed inside the first laundry treating chamber supply pipe 24, a condenser (C, 312) disposed inside the first laundry treating chamber supply pipe 24, and a compressor (P, 33) and an expansion valve (Ex, 34) located outside the first laundry treating chamber supply pipe 24.

The evaporator E, the compressor P, the condenser C, and the expansion valve Ex are connected to each other through a refrigerant pipe 35.

The compressor P refers to means of compressing refrigerant to high pressure so that the refrigerant may be circulated along the refrigerant pipe 35. The evaporator E refers to means to evaporate the refrigerant by absorbing heat from air inside the first laundry treating chamber supply pipe 24 and to dehumidify and cool the air. The condenser C refers to means of heating the air and condensing the refrigerant by releasing heat into air inside the first laundry treating chamber supply pipe 24.

The blowing fan 32 refers to means that is located inside the first laundry treating chamber supply pipe 24 to allow air inside the receiving space 14 to be circulated along the first laundry treating chamber supply pipe 24, and is located between the condenser C and the air outlet 36.

Therefore, when the blowing fan 32 is activated, air inside the first laundry treating chamber supply pipe 24 moves to the receiving space 14 through the air outlet 36, and the air inside the receiving space 14 is transferred to the first laundry treating chamber supply pipe 24 through the air inlet 37.

Air flowing into the first laundry treating chamber supply pipe 24 through the air inlet 23 is cooled while passing through the evaporator E. Air passing through the evaporator E is heated while passing through the condenser C.

When the air is cooled while passing through the evaporator E, the moisture contained in the air is removed (dehumidification), and the moisture (condensed water) removed from the air remains on a face of the evaporator or inside the first laundry treating chamber supply pipe.

When the condensed water remains inside the first laundry treating chamber supply pipe 24, the heat exchange efficiency of heat-exchanger 31 decreases. Thus, the laundry treating apparatus according to the present disclosure may further include a water discharger for removal of the condensed water generated by the evaporator E.

On one side of the first laundry treating chamber supply pipe 24 according to the present embodiment, a water collection pipe 37 for collecting the condensed water generated via the heat exchange with the evaporator E may be disposed. The condensed water collected by the water collection pipe 37 may flow to the water discharger.

The water discharger may include a water discharge tank 47 detachably disposed on the machine chamber door 22, and a water discharge pipe 477 and a water discharge pump 479 supplying the condensed water inside the first laundry treating chamber supply pipe 24 to the water discharge tank 47.

The water discharge tank 47 may have any shape as long as the tank may provide a space for storing liquid therein. However, it is preferable that the tank 47 includes a water discharge tank lid 471 for discharging the liquid stored in the water discharge tank 47, and a water discharge tank inlet 473 to which the water discharge pipe 477 is detachably connected.

A check valve (not shown) may be further disposed at the water discharge tank inlet 473. Thus, when the machine chamber door 22 opens the machine chamber 20, the water discharge pipe 477 may be separated from the water discharge tank inlet 473. The water discharge pipe 477 may be inserted into the water discharge tank inlet 473 when the machine chamber door 22 closes the machine chamber 20. Further, when the water discharge tank is separated from the machine chamber door, the water inside the water discharge tank may be prevented from leaking to the outside of the water discharge tank.

In one example, as shown in (b) FIG. 2, the steam supply 40 may include a steam generator 41 disposed inside the machine chamber 20, a heater 411 disposed inside the steam generator 41, and a steam supply pipe 417 that connects the steam generator 41 to a steam supply hole 42.

The steam generator 41 refers to means for storing water. The heater 411 refers to means for changing water into steam by heating water stored in the steam generator 41. The steam supply pipe 417 refers to means for guiding the steam inside the steam generator 41 to the receiving space 14.

Therefore, the heater 411 is preferably disposed to be adjacent to the bottom face of the steam generator 41. The steam supply pipe 417 is preferably located on a top face (topmost level) of the steam generator 41.

The steam generator 41 is supplied with water through a water supply. The water supply may include the water supply tank 45 detachably disposed on the machine chamber door 22.

In this case, the steam generator 41 may be configured to further include a water supply tank connection pipe 413 that is connected to the water supply tank 45 when the machine chamber door 22 closes the machine chamber 20, and is separated from the water supply tank 45 when the machine chamber door 22 opens the machine chamber 20.

The water supply tank 45 may have any shape as long as liquid may be stored therein. However, it is preferable that the water supply tank 45 is configured to include a water supply tank lid 451 for supplying liquid into the water supply tank 45, a discharge hole (not shown) into which the water supply tank connection pipe 413 is inserted, and a water supply tank check valve 455 disposed at the discharge hole.

The configuration that the water supply tank 45 is disposed in a detachable manner on the machine chamber door 22 is made based on a case where the laundry treating apparatus 1000 according to the present disclosure is installed at a location far away from a water supply source (not shown).

That is, when the laundry treating apparatus 1000 is placed adjacent to the water supply source, the steam generator 41 may be controlled to receive water from the water supply source when needed. However, when a location where the laundry treating apparatus 1000 is installed is far away from the water supply source, the above-described control is impossible. Thus, the water supply tank 45 may solve such a problem.

In addition, the water supply tank 45 and the water discharge tank 47 may be combined into one storage tank rather than being separate components. In this case, the condensed water stored in the storage tank may be reused, or may be directly discharged to the outside through the water discharge pipe 477 without being stored in the storage tank.

Figure 3:
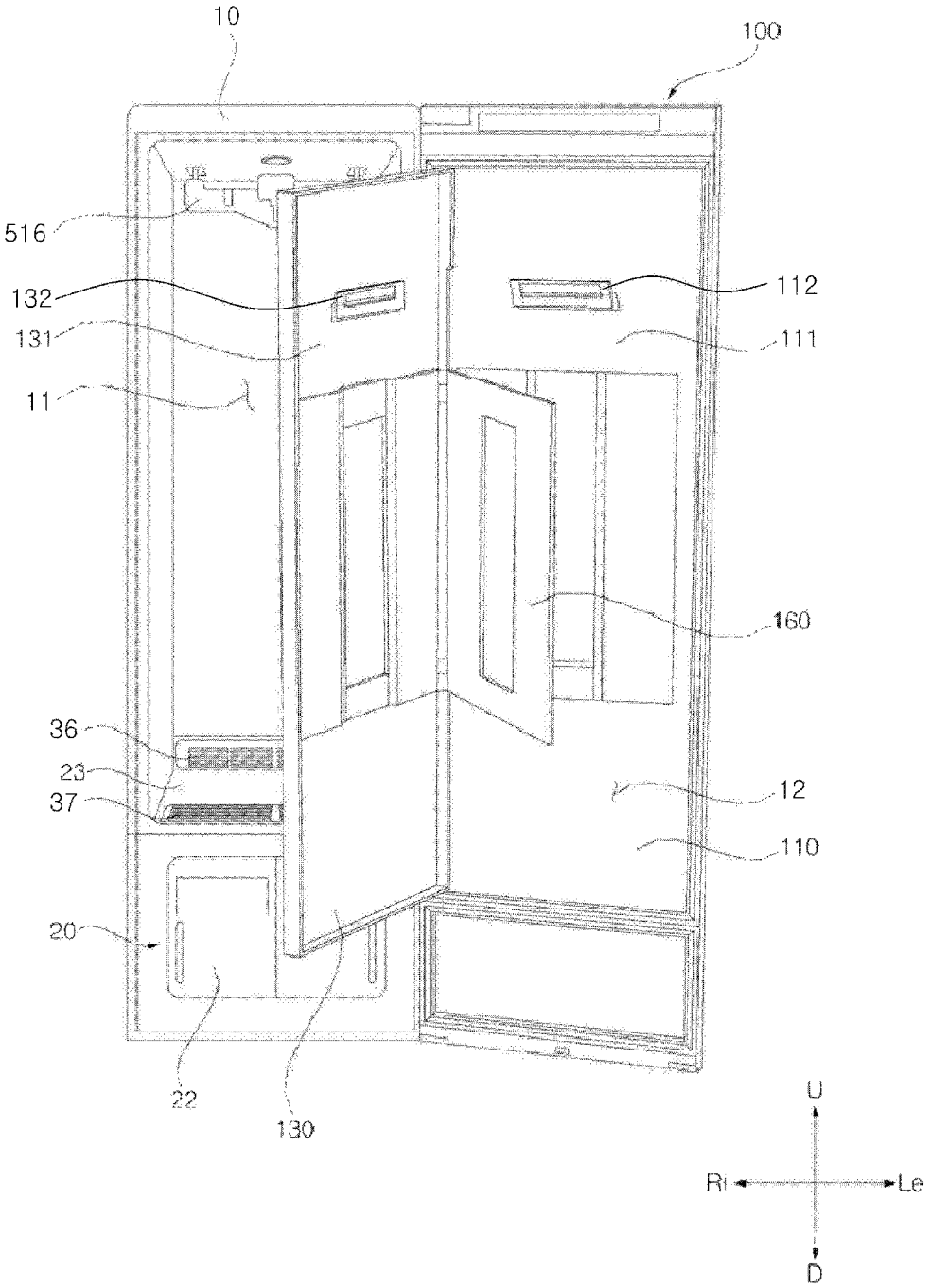
FIG. 3 shows a state in which a door of a laundry treating apparatus according to an embodiment of the present disclosure is opened.

FIG. 3 is a view of a state in which the door assembly 100 of the laundry treating apparatus 1000 according to an embodiment of the present disclosure is opened. Referring to FIG. 3, a configuration of the laundry treating apparatus 1000 according to the present embodiment will be described once again as follows.

The laundry treating apparatus 1000 according to this embodiment includes a cabinet 10 having a hollow interior and an open front face, and a door assembly 100 that opens and closes the open front face of the cabinet 10.

The cabinet 10 according to the present embodiment includes the first laundry treating chamber 11 in which laundry is held and is treated using steam or air circulation, and the machine chamber 20 in which a device for injecting steam or circulating air are installed.

The machine chamber 20 according to this embodiment includes a separation plate 23 covering a top (U) of the machine chamber 20 so as to distinguish between the machine chamber 20 and the first laundry treating chamber 11, and a machine chamber door 22 disposed on a front face of the machine chamber 20 and 23 to open and close the inside of the machine chamber 20. The separation plate 23 is placed on the top (U) of the machine chamber 20. The air inlet 37 through which air from the first laundry treating chamber 11 flows into the machine chamber, and the air outlet 36 through which air inside the machine chamber flows into the first laundry treating chamber 11 are defined in the separation plate 23.

As described above, the first laundry treating chamber supply pipe 24 may be disposed in the machine chamber 20 according to the present embodiment. The first laundry treating chamber supply pipe 24 may receive air from the first laundry treating chamber 11 and send the air back to the first laundry treating chamber 11. Air flowing from the first laundry treating chamber to the first laundry treating chamber supply pipe 24 may exchange heat with the condenser 36 and the evaporator 40.

Further, the steam supply 40 generates steam using the heater 411 heating water supplied from the water supply tank 45. The steam generated by the steam supply 40 is supplied to the first laundry treating chamber 11 to remove wrinkles from the laundry.

The steam generated from the steam generator 41 may be supplied to the first laundry treating chamber 11 through a steam supply pipe 417. Referring to FIG. 2, the steam supply pipe 417 according to the present embodiment is shown to be combined with the first laundry treating chamber supply pipe 24 to communicate with the first laundry treating chamber 11. Alternatively, the steam supply pipe 417 may not be combined with the first laundry treating chamber supply pipe 24 but may communicate directly to the first laundry treating chamber 11 through a separate hole (not shown) that passes through the separation plate 23.

Figure 4:
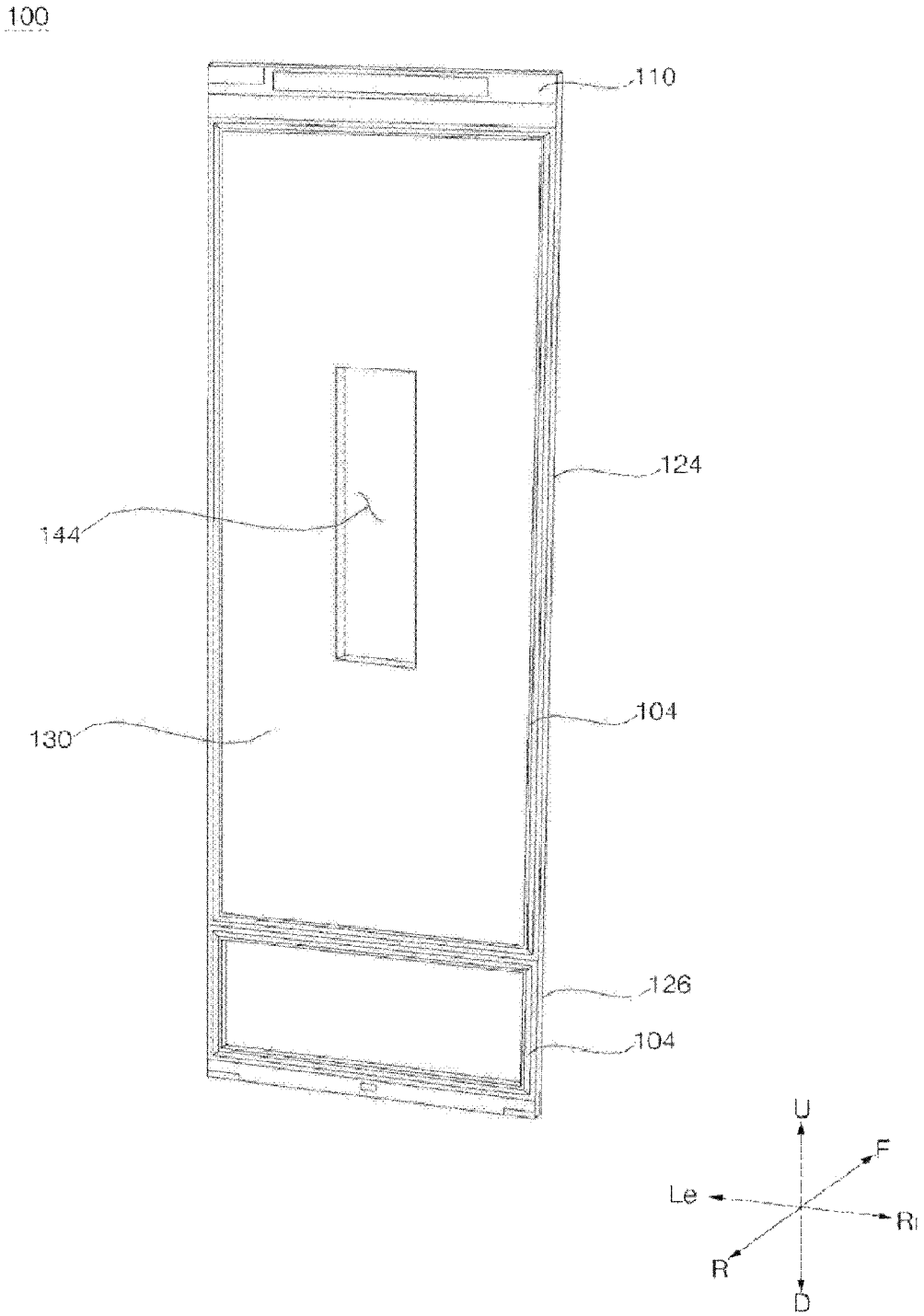
FIG. 4 shows a closed state of a door assembly according to an embodiment of the present disclosure.
Figure 5:
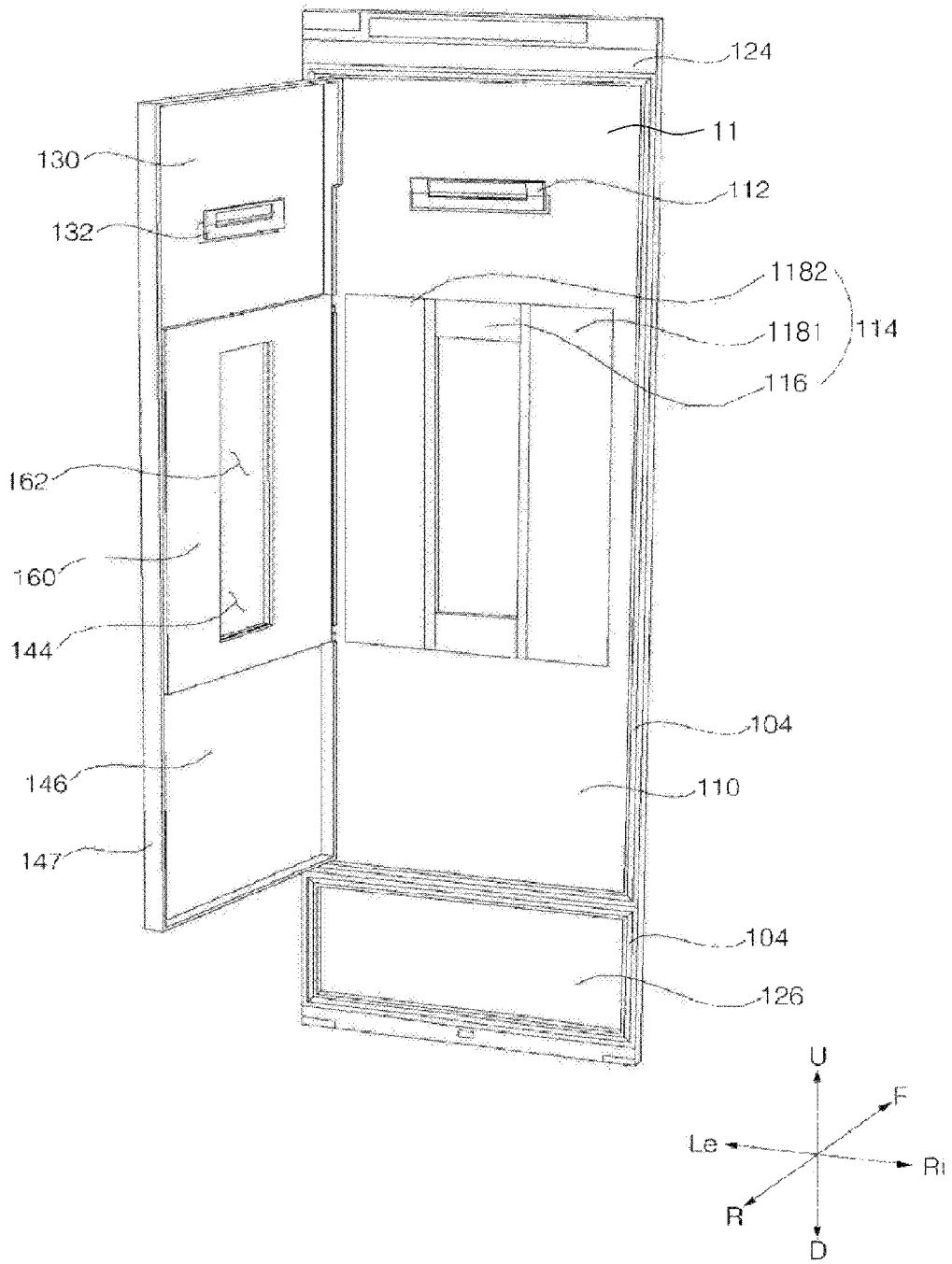
FIG. 5 shows a door assembly in an open state according to an embodiment of the present disclosure.
Figure 6:
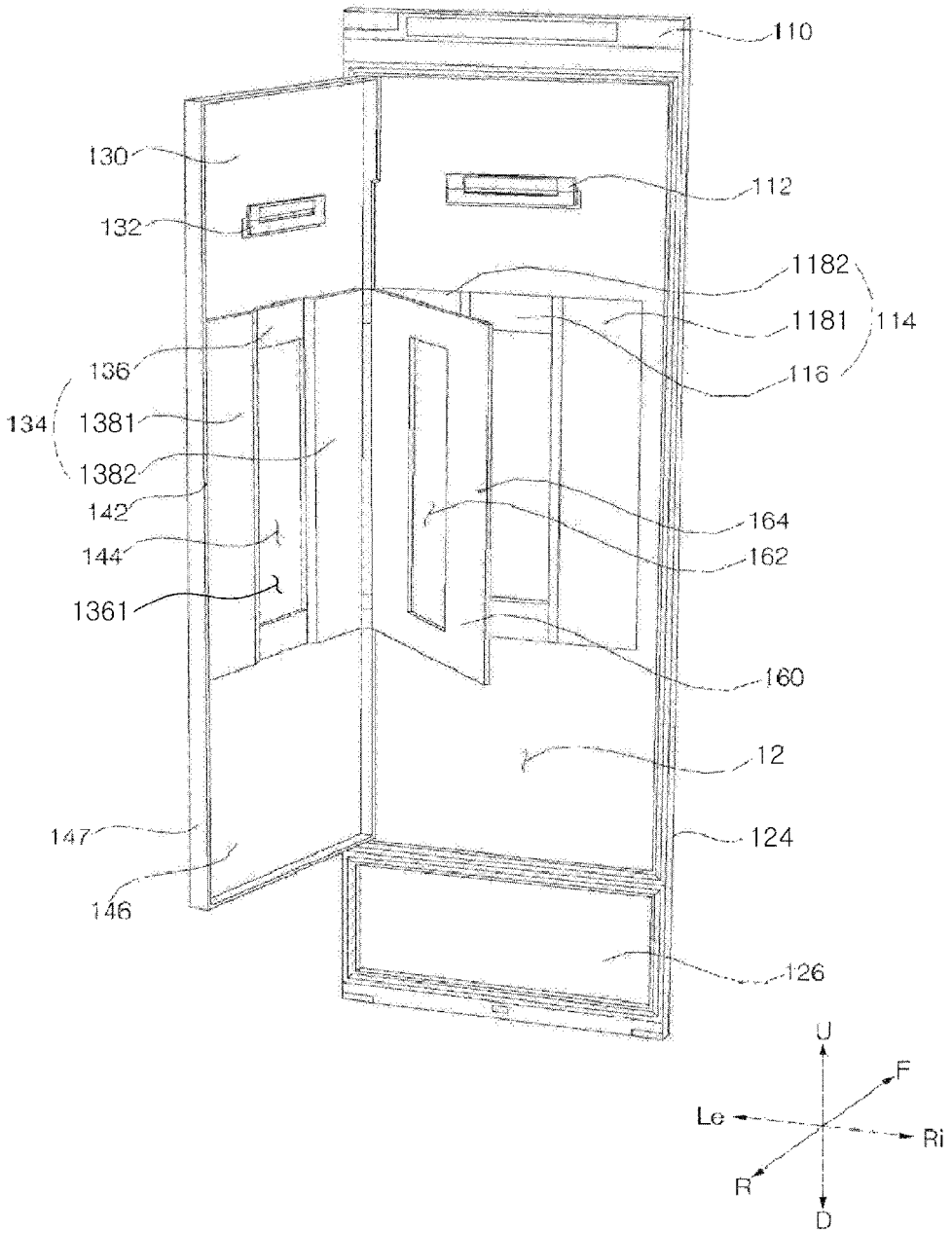
FIG. 6 shows a state in which a door assembly is opened and a partitioning plate is in a spaced state according to an embodiment of the present disclosure.
Figure 7:
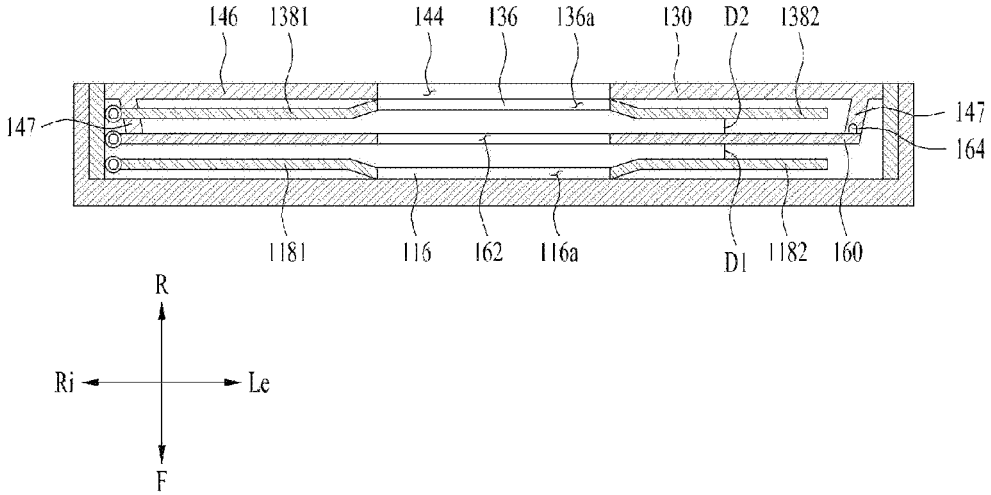
FIG. 7 is a diagram for describing arrangement between a first panel, a second panel, and a partitioning plate of a door assembly according to an embodiment of the present disclosure.

Hereinafter, with reference to FIG. 4 to FIG. 6, s configuration and an opening and closing structure of the door assembly 100 according to an embodiment of the present disclosure will be described. FIG. 6 is a diagram for describing an arrangement between a first panel 110, a second panel 130, and a partitioning plate 160 of the door assembly 100 according to an embodiment of the present disclosure.

Hereinafter, a structure and an arrangement of an interior of the door assembly according to the present embodiment will be described with reference to FIG. 4 to FIG. 7.

The door assembly 100 according to this embodiment has a second laundry treating chamber 12 defined therein capable of removing wrinkles by pressing at least two garments therein. The second laundry treating chamber according to this embodiment is formed inside the door assembly 100.

The door assembly 100 according to the present embodiment includes the first panel 110 pivotably connected to the cabinet 10, the second panel 130 pivotably connected to the first panel 110, and the partitioning plate 160 disposed between the first panel 110 and the second panel 130 to press laundry disposed on both sides thereof. The second laundry treating chamber to press laundry is formed in a space between the first panel 110 and the second panel 130 according to this embodiment.

In the door assembly 100 according to the present embodiment, the second laundry treating chamber 12 to press at least two garments may be formed between the first panel 110 and the second panel 130.

The first panel 110 according to this embodiment may cover a front face of the cabinet 10. The first panel 110 according to this embodiment is sized such that the panel 110 covers both the first laundry treating chamber 11 and the machine chamber 20 of the cabinet 10. The first panel 110 according to this embodiment is placed on the open front face of the cabinet 10. The first panel 110 according to this embodiment is pivotably connected to the cabinet 10 and opens and closes the opened front face of the cabinet 10. On a rear face of the first panel 110, a door gasket 104 is placed along an edge portion of the first panel in contact with the cabinet 10 to seal the first laundry treating chamber 11 formed inside the cabinet 10 from the outside when the first panel closes the front face of the cabinet 10.

A portion of an inner face 111 of the first panel 110 according to this embodiment is recessed inwardly to define a space forming the second laundry treating chamber 12.

The front face of the first panel 110 according to this embodiment together with the cabinet 10 may form an appearance of the laundry treating apparatus 1000. On the inner face 111 of the first panel 110 according to the present embodiment, a first fixing member 112 for fixing the laundry, and a first base plate 114 for pressing the laundry fixed to the first panel 110 together with the partitioning plate 160 are disposed.

In the door assembly 100 according to the present embodiment, a face thereof disposed on the space forming the second laundry treating chamber 12 in a state where the second panel 130 is in a closed state relative to the first panel 110 may be defined as an inner face 111 thereof. Further, in the door assembly 100 according to the present embodiment, a face forming an appearance of the door assembly 100 while the second panel 130 is in a closed state relative to the first panel 110 may be defined as an outer face thereof. Therefore, referring to FIG. 4, a face that forms the outer face of the door assembly 100 as the rear face of the first panel 110 may be defined as the outer face thereof.

The first base plate 114 includes a first base fixing plate 116 fixed to the first panel 110, and first base elastic plates 1181 and 1182 which extend from the first base fixing plate 116, and are spaced apart from the inner face 111 of the first panel 110 by a larger spacing than the first base fixing plate 116 is. The first base elastic plates 1181 and 1182 apply elasticity to laundry.

In this embodiment, the first base fixing plate 116 may be formed to extend from the inner face 111 of the first panel 110 in a vertical direction (U-D), and may be fastened to the first panel 110 via fasteners at a top (U) and a bottom (D) thereof. Thus, the first base fixing plate 116 may remain in a coupled state to the inner face of the first panel 110. The first base fixing plate 116 may have a first base fixing plate hole 1161 defined in a center portion thereof as a portion other than the portion fastened to the first panel 110. A portion of the first base plate 114 that mainly presses the laundry may correspond to the first base elastic plates 1181 and 1182. Therefore, forming the first base fixing plate hole 1161 at the center portion of the first base fixing plate 116 except for the portion fastened to the first panel 110 may allow reducing a cost used for manufacturing the first base plate 114.

The first base elastic plates 1181 and 1182 may include a first right base elastic plate 1181 and a first left base elastic plate 1182 extending in left and right directions from the first base fixing plate 116, respectively.

The first right base elastic plate 1181 and the first left base elastic plate 1182 may be elastically deformed toward the inner face 111 of the first panel 110 due to elasticity of the material thereof.

Thus, when the first base plate 114 is pressed against the partitioning plate 160, the first base elastic plates 1181 and 1182 of the first base plate 114 are spaced apart from the inner face 111 of the first panel 110 so that they may uniformly and closely contact the partitioning plate 160.

The first panel 110 according to this embodiment includes an upper cover 124 forming a space of the second laundry treating chamber 12 defined between the second panel 130 and the upper cover 124, and a lower cover 126 disposed under the upper cover 124 to cover the front face of the machine chamber 20.

The second panel 130 according to this embodiment is pivotably connected to one side of the first panel 110. The second panel 130 forms the second laundry treating chamber 12 as the space between the first panel 110 and the second panel 130 when the second panel 130 closes the recessed space of the first panel 110. The second panel 130 according to this embodiment is formed to have a size smaller than that of the first panel 110. The second panel 130 according to the present embodiment may have a size corresponding to a size of the upper cover 124 of the first panel 110.

Referring to FIG. 4 to FIG. 7, the second panel 130 according to this embodiment is closer to the first laundry treating chamber 11 than the first panel 110 is. The second panel 130 according to this embodiment may be disposed in rear R of the first panel 110. The second panel 130 according to this embodiment may face the rear face of the first panel 110.

The second panel 130 according to this embodiment has a communication hole 144 that communicates the first laundry treating chamber 11 and the second laundry treating chamber 12 with each other.

The second panel 130 according to this embodiment may be hinge-connected to one side of the first panel 110. The second panel 130 according to the present embodiment includes a panel plate 146 for opening and closing the second laundry treating chamber, and an edge portion 147 protruding from an edge of the panel plate 146 toward the first panel 110. The first panel 110 is spaced by a certain spacing from the inner face 131 of the second panel 130. When the second panel 130 and the first panel 110 close the second laundry treating chamber 12, the second panel 130 according to this embodiment is spaced apart from the inner face 111 of the first panel 110.

On the inner face 131 of the second panel 130 according to this embodiment, a second fixing member 132 for fixing the laundry, and a second base plate 134 for pressing the laundry fixed on the second panel 130 together with the partitioning plate 160 are disposed.

The second base plate 134 includes a base fixing plate 136 fixed to the second panel, and second base elastic plates 1381 and 1382 extending from the base fixing plate 136 and being spaced apart from the inner face 131 of the second panel 130 by a larger spacing than the base fixing plate 136 is. The second base elastic plates 1381 and 1382 apply elasticity to laundry. The second base plate 134 may have approximately the same configuration as that of the first base plate 114.

A second base fixing plate hole 1361 may be formed in a central portion of the second base fixing plate 136 according to the present embodiment as a portion other than the portion fastened to the second panel 130. The second base fixing plate hole 1361 according to the present embodiment may be formed in a region corresponding to that of the communication hole 144 formed in the second panel 130.

The communication hole 144 formed in the second panel 130 according to the present embodiment may be formed in a region corresponding to a region in which the second base fixing plate hole 1361 of the base fixing plate 136 is formed. Air or steam flowing through the first laundry treating chamber 11 may be supplied to the second laundry treating chamber through the communication hole 144 of the second panel 130 and the second base fixing plate hole 1361 formed in the base fixing plate 136. Further, air from the second laundry treating chamber 12 may be discharged to the first laundry treating chamber 11 through the communication hole 144 of the second panel 130 and the second base fixing plate hole 1361 formed in the base fixing plate 136.

The partitioning plate 160 according to this embodiment is disposed between the first panel 110 and the second panel 130 to press each of laundry held on the first panel 110 and laundry held on the second panel 130. The partitioning plate 160 according to the present embodiment has a rectangular plate shape, and an opening 162 opened in a front-rear direction (F-R) may be formed in a center of the partitioning plate 160.

The partitioning plate 160 is hinge-coupled to one side of the first panel 110 or the second panel 130. Referring to FIG. 5 to FIG. 6, the partitioning plate 160 according to this embodiment is hinge-coupled to one side of the second panel 130. The partitioning plate 160 according to this embodiment is pivotably coupled to the second panel 130 at one side thereof, while the partitioning plate 160 is detachably coupled to the second panel 130 at the other side thereof. When the partitioning plate 160 according to the present embodiment is coupled to the second panel 130 at the other side thereof, the partitioning plate 160 may be spaced from the second panel 130.

The partitioning plate 160 according to this embodiment includes a hinge 140 that is pivotably coupled to the second panel 130, and a fixing protrusion 164 to fix or separate the partitioning plate 160 to or from one side of the second panel 130 as the partitioning plate pivots around the hinge 140. A fixing groove 142 configured to be fixed to or be separated from the fixing protrusion 164 may be defined in one side of the second panel 130 according to the present embodiment.

The fixing protrusion 164 of the partitioning plate 160 and the fixing groove 142 of the second panel 130 according to the present embodiment may be engaged with each other in one-touch click button manner. Therefore, when the user presses the fixing protrusion 164 of the partitioning plate 160 toward the second panel 130, the partitioning plate 160 may be fixed to the second panel 130 or may be released therefrom.

The fixing protrusion 164 may fix the partitioning plate 160 to the second panel 130 such that a spacing between the partitioning plate 160 and the second panel 130 is maintained. Thus, the partitioning plate 160 may press the laundry held on the second panel 130. The fixing protrusion 164 allows the partitioning plate 160 to be separated from the second panel 130, such that the laundry may be held on the second panel 130, or the laundry may be removed from the second panel 130.

The first panel 110 and the second panel 130 according to this embodiment are spaced apart from each other by a certain spacing. The first panel 110, the partitioning plate 160, and the second panel 130 according to this embodiment are spaced apart from each other by a certain spacing. While the second laundry treating chamber 12 is in a closed state, a spacing D1 from each of the first base elastic plates 1181 and 1182 of the first panel 110 and the partitioning plate 160 may be equal to a spacing D2 between the partitioning plate 160 and each of the second base elastic plates 1381 and 1382 of the second panel 130. While the second laundry treating chamber 12 is in a closed state, the spacing D1 from each of the first base elastic plate 1181 and 1182 of the first panel 110 and the partitioning plate 160 and the spacing D2 between the partitioning plate 160 and each of the second base elastic plates 1381 and 1382 of the second panel 130 may include '0'. That is, while the second laundry treating chamber 12 is in a closed state, the first base elastic plates 1181 and 1182 of the first panel 110 and the second base elastic plates 1381 and 1382 of the second panel 130 may be in close contact with the partitioning plate 160.

However, while the second laundry treating chamber 12 is in a closed state, the spacing D1 between each of the first base elastic plates 1181 and 1182 of the first panel 110 and the partitioning plate 160 and the spacing D2 between the partitioning plate 160 and each of the second base elastic plates 1381 and 1382 of the second panel 130 may be set to different from each other in consideration of a type of laundry to be held thereon.

While the second laundry treating chamber 12 is in a closed state, the first base elastic plates 1181 and 1182 of the first base plate 114 and the second base elastic plates 1381 and 1382 of the second base plate 134 may be in contact with or may be close to the partitioning plate 160. When the second laundry treating chamber 12 is in a closed state, when laundry is held on the first panel 110, the first base elastic plates 1181 and 1182 may be moved toward the first panel 110 due to the held laundry. While the second laundry treating chamber 12 is in a closed state, when laundry is held on the second panel 130, the second base elastic plates 1381 and 1382 may be moved toward the second panel 130 due to the held laundry.

When the fixing protrusion 164 of the partitioning plate 160 is fixed to the fixing groove 142 of the second panel 130, the partitioning plate 160 and the second base plate 134 of the second panel 130 may press the laundry held on the second panel 130. When the partitioning plate 160 is fixed to the second panel 130, and the second panel 130 is fixed to the first panel 110, the partitioning plate 160 and the first base plate 114 of the first panel 110 may press the laundry held on the first panel 110.

Figure 8:
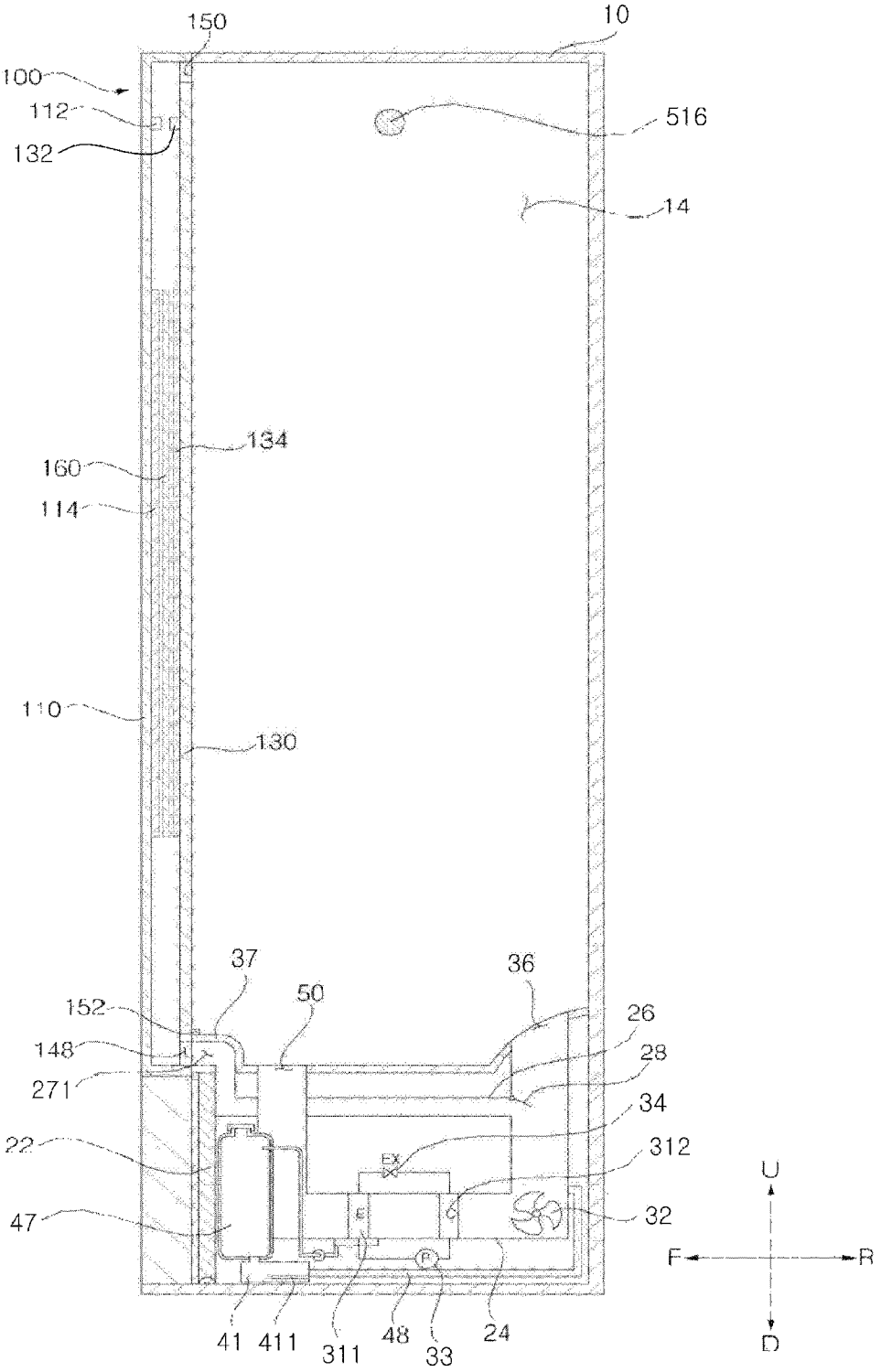
FIG. 8 shows a schematic cross-sectional view of a laundry treating apparatus having a structure of a machine chamber according to another embodiment of the present disclosure.

FIG. 8 is a schematic cross-sectional view of a laundry treating apparatus having a structure of a machine chamber according to another embodiment of the present disclosure. Hereinafter, the laundry treating apparatus according to another embodiment of the present disclosure will be described with reference to FIG. 8.

The laundry treating apparatus 1000 according to this embodiment may include a second laundry treating chamber supply pipe 26 for supplying steam to the second laundry treating chamber 12 formed inside the door assembly 100.

The second laundry treating chamber supply pipe 26 according to the present embodiment may be a pipe branched from a downstream portion of the first laundry treating chamber supply pipe 24 to which steam from the steam supply pipe 48 is fed. In the separation plate 23 of the machine chamber 20 according to this embodiment, a second laundry treating chamber supply 27 is formed which has a second laundry treating chamber supply hole 271 defined therein to supply steam flowing through the second laundry treating chamber supply pipe 26 to the door assembly 100. The second laundry treating chamber supply part 27 may protrude upwardly from a top (U) of the separation plate 23. The second laundry treating chamber supply hole 271 according to this embodiment is opened in a top of the machine chamber 20 and in a front direction (F). A door inflow hole 148 communicating with the second laundry treating chamber 12 of the door assembly 100 is formed in front (F) of the second laundry treating chamber supply hole 271 and in the second panel 130 of the door assembly 100.

The second laundry treating chamber supply pipe 26 according to this embodiment is branched from one side of the first laundry treating chamber supply pipe 24, and is connected to the second laundry treating chamber supply hole 271 formed in a front portion (F) of the machine chamber 20. An adjustment cover 28 to control steam supply to the second laundry treating chamber supply pipe 26 may be placed at one side of the first laundry treating chamber supply pipe 24 connected to the second laundry treating chamber supply pipe 26. The adjustment cover 28 is placed at one side of the first laundry treating chamber supply pipe 24, and opens and closes the first laundry treating chamber supply pipe 24 to control flow toward the first laundry treating chamber supply pipe 24. Therefore, when the adjustment cover 28 opens the first laundry treating chamber supply pipe 24, the steam flowing through the first laundry treating chamber supply pipe 24 may be guided to flow into the second laundry treating chamber supply pipe 26.

Referring to FIG. 8, the second panel 130 of the door assembly 100 according to this embodiment has a door inflow hole 148 defined therein through which the steam flowing through the second laundry treating chamber supply hole 271 is supplied to the second laundry treating chamber 12 of the door assembly 100, and a door discharge hole 150 defined therein through which steam or air flowing through the second laundry treating chamber 12 is exhausted to the first laundry treating chamber 11.

The door inflow hole 148 according to this embodiment may be disposed at a bottom of the second panel 130, and the door discharge hole 150 may be placed at a top of the second panel 130. The second panel 130 according to this embodiment may have a door inflow hole-gasket 152 disposed around the door inflow hole 148. The door inflow hole-gasket 152 according to this embodiment seals an area around the second laundry treating chamber supply hole 271 of the machine chamber 20 when the door assembly 100 is in a closed state, thereby to prevent steam or air flowing through the second laundry treating chamber supply pipe 26 of the machine chamber 20 from leaking to a space other than the second laundry treating chamber 12 formed inside the door assembly 100.

Figure 9:
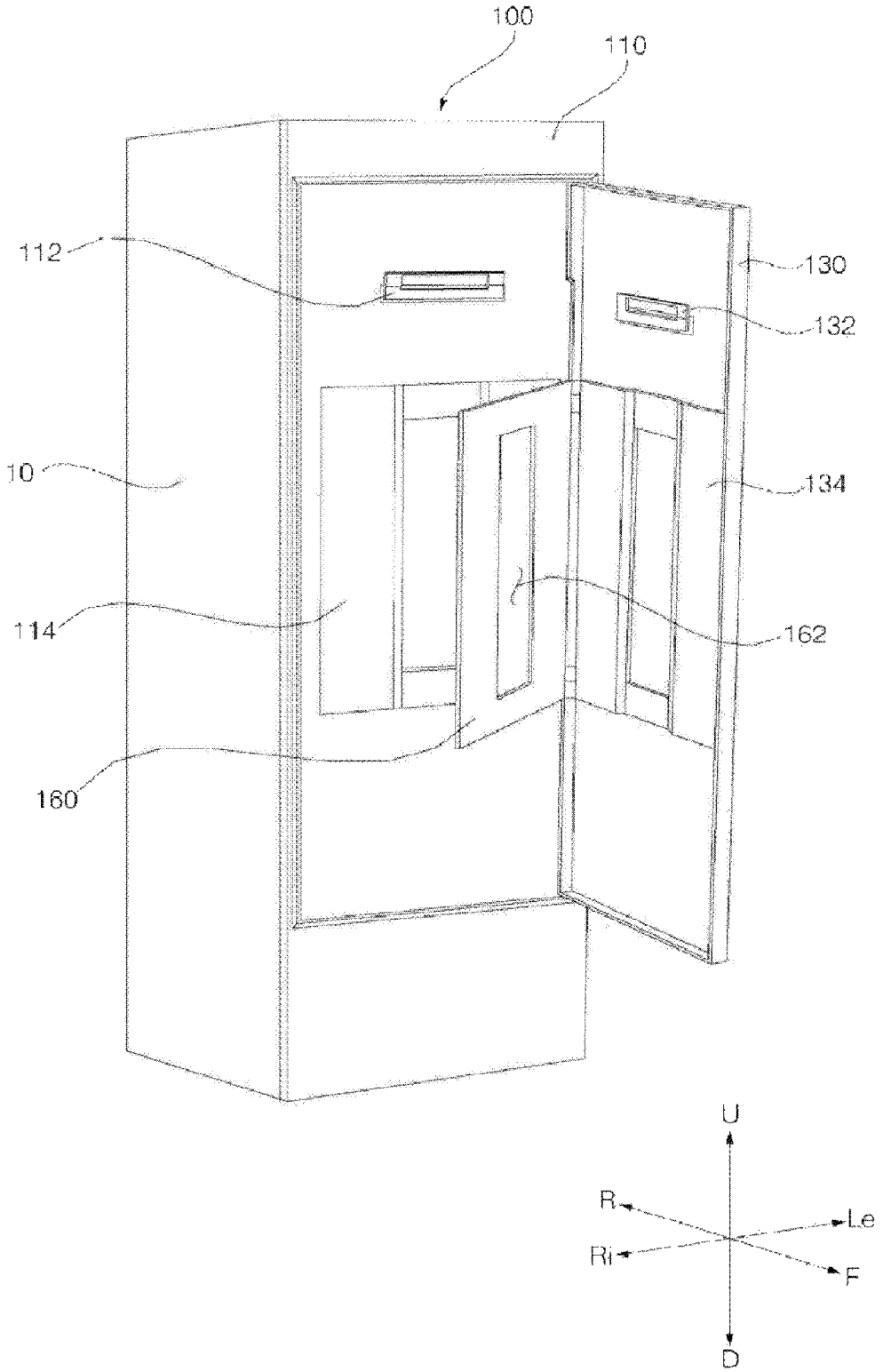
FIG. 9 is a diagram for describing a laundry treating apparatus including a door assembly according to another embodiment of the present disclosure.
Figure 10:
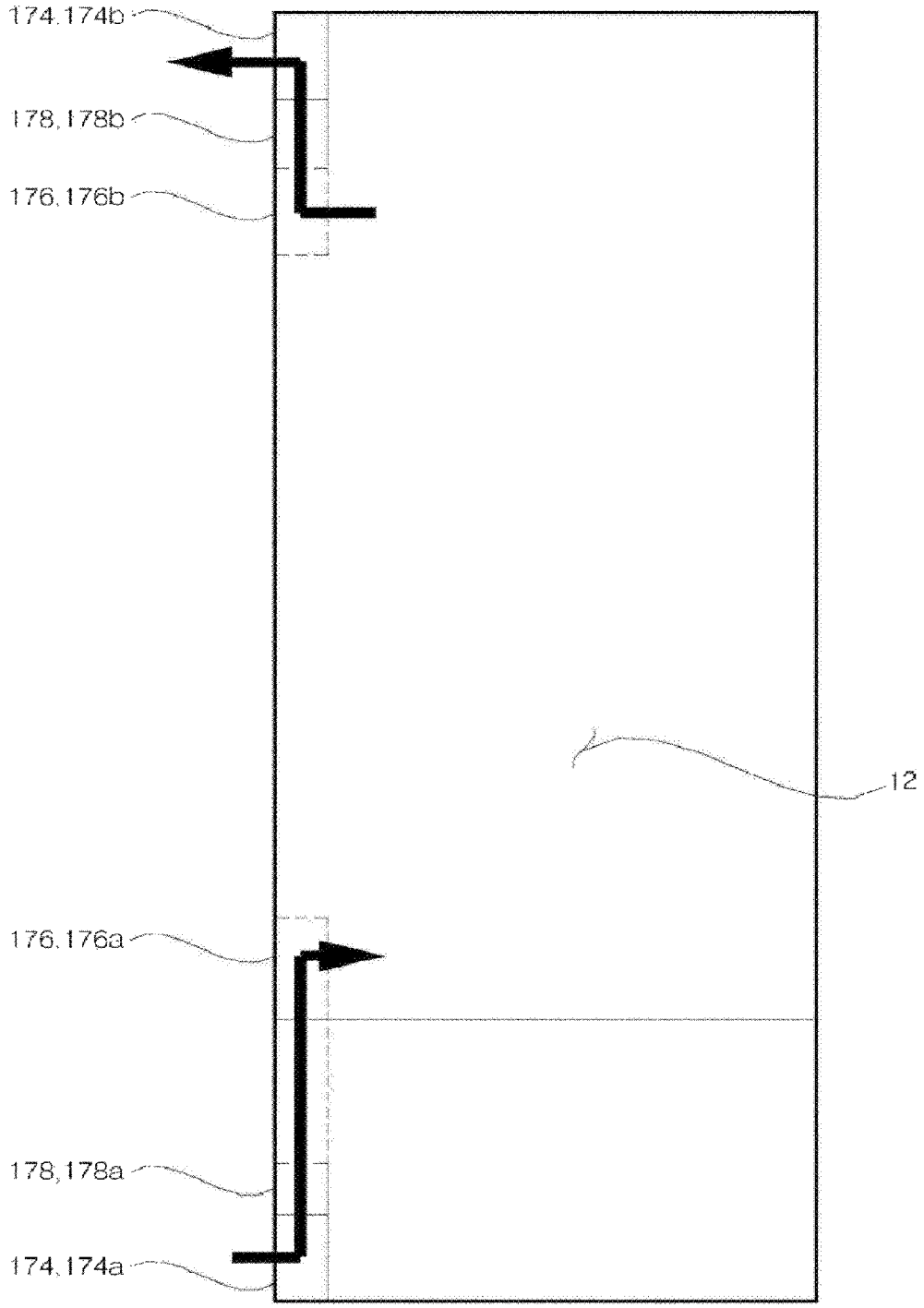
FIG. 10 is a diagram for describing a configuration for flow of steam of a door assembly according to another embodiment of the present disclosure.

FIG. 9 is a diagram for describing a laundry treating apparatus 1000 including a door assembly 100 according to another embodiment of the present disclosure. FIG. 10 is a diagram for describing a configuration for flow of steam of the door assembly 100 according to another embodiment of the present disclosure.

Hereinafter, the laundry treating apparatus according to another embodiment of the present disclosure will be described with reference to FIG. 9 to FIG. 10.

Referring to FIG. 9, the laundry treating apparatus 1000 according to this embodiment may have a structure in which the second panel 130 is opened to an outside of the first panel 110.

The laundry treating apparatus 1000 according to this embodiment includes the first panel 110 which is pivotably connected to the cabinet 10, the second panel 130 pivotably connected to the first panel 110, and the partitioning plate 160 disposed between the first panel 110 and the second panel 130 to press laundry disposed on both sides thereof.

The first panel 110 according to this embodiment opens and closes the open front face of the cabinet 10. The second panel 130 according to this embodiment is disposed in front (F) of the first panel 110.

The door assembly 100 according to the present embodiment may open and close only the second panel 130 while the door assembly 100 closes the cabinet 10. Therefore, even when laundry is being treated in the first laundry treating chamber 11, the second laundry treating chamber 12 may be opened to treat laundry such as pants via pressing thereof therein.

Referring to FIG. 10, the steam supply 40 of the laundry treating apparatus 1000 according to the present embodiment may supply steam to the second laundry treating chamber 12 formed inside the door assembly 100. The laundry treating apparatus 1000 according to the present embodiment may further include door steam dischargers 174*b* 176*b*, and 178*b* for exhausting steam flowing inside the door assembly 100.

Door steam supplies 174*a*, 176*a*, and 178*a* according to this embodiment may supply a portion of the steam generated from the steam supply 40 disposed inside the machine chamber 20 to the second laundry treating chamber 12 inside the door assembly 100.

The door assembly 100 according to this embodiment is pivotably connected to the cabinet 10. The laundry treating apparatus 1000 according to this embodiment further includes a cabinet hinge 174 pivotably connecting the door assembly 100 to the cabinet 10. The cabinet hinge 174 according to this embodiment may pivotably connect the door assembly 100 and the cabinet 10 at each of the top and the bottom of the door assembly 100.

The cabinet hinge 174 according to this embodiment includes a first the cabinet hinge 174*a* disposed at the top of the door assembly 100, and a second the cabinet hinge 174*b* disposed at the bottom of the door assembly 100. Each of the first the cabinet hinge 174*a* and the second the cabinet hinge 174*b* according to this embodiment may have a hollow interior. Thus, a hose in which steam flows may be received in the first the cabinet hinge 174*a* and the second the cabinet hinge 174*b*. Alternatively, steam may flow in the first the cabinet hinge 174*a* and the second the cabinet hinge 174*b*.

The second panel 130 of the door assembly 100 according to this embodiment is pivotably connected to the first panel 110. The door assembly 100 according to the present embodiment further includes an assembly hinge 176 pivotably connecting the second panel 130 to the first panel 110. The assembly hinge 176 according to this embodiment pivotably connects the second panel 130 to the first panel 110 at each of the top and the bottom of the second panel 130.

The assembly hinge 176 according to the present embodiment includes a first assembly hinge 176*a* disposed at the top of the second panel 130 and the second assembly hinge 176*b* disposed at the bottom of the second panel 130. Each of the first assembly hinge 176*a* and the second assembly hinge 176*b* according to the present embodiment may have a hollow interior. Thus, a hose in which steam flows may be received in the first assembly hinge 176*a* and the second assembly hinge 176*b*. Alternatively, steam may flow in the first assembly hinge 176*a* and the second assembly hinge 176*b*.

The door assembly 100 according to the present embodiment further includes a connection pipe 178 connecting the cabinet hinge 174 and the assembly hinge 176 to each other. The connection pipe 178 according to the present embodiment may be disposed inside the door assembly 100 to connect the cabinet hinge 174 and the assembly hinge 176 with each other.

The connection pipe 178 according to the present embodiment may include a first connection pipe 178*a* connecting the first the cabinet hinge 174*a* and the first assembly hinge 176*a* with each other, and a second connection pipe 178*b* connecting the second the cabinet hinge 174*b* and the second assembly hinge 176*b* with each other.

Steam generated from the steam supply 40 of the machine chamber 20 flows into the connection pipe 178 according to the present embodiment, or a hose through which steam flows may be disposed in the connection pipe 178.

The connection pipe 178 according to the present embodiment may include a first connection pipe 178*a* connecting the first the cabinet hinge 174*a* and the first assembly hinge 176*a* with each other. The connection pipe 178 according to this embodiment may include a second connection pipe 178*b* connecting the second the cabinet hinge 174*b* and the second assembly hinge 176*b* with each other.

Figure 11:
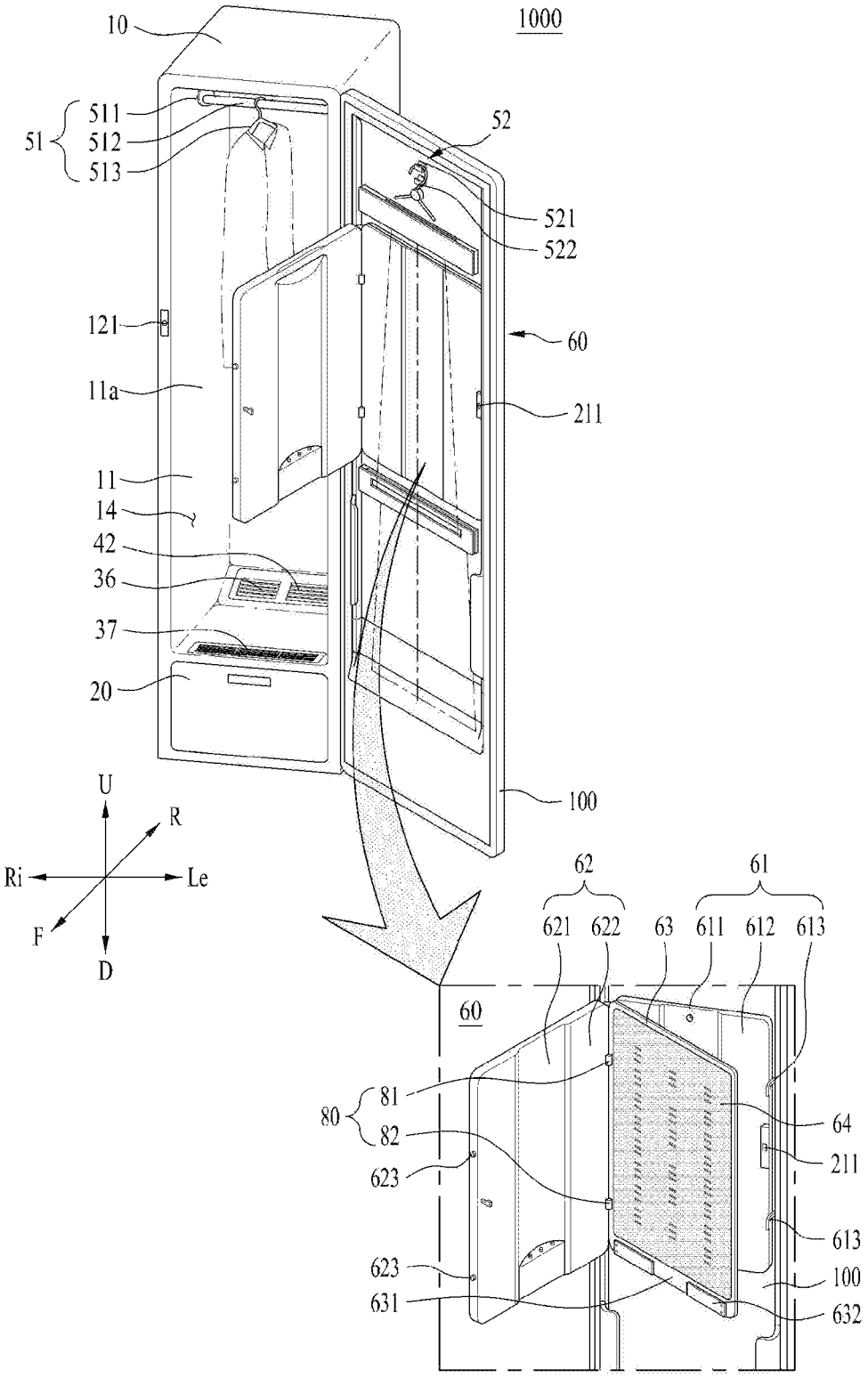
FIG. 11 shows a structure of a laundry treating apparatus according to an embodiment of the present disclosure.

FIG. 11 shows another embodiment of a laundry treating apparatus 1000.

Referring to FIG. 11, the laundry treating apparatus 1000 according to the present disclosure includes the cabinet 10 with a front opening, the door assembly 100 pivotably coupled to the cabinet 10 to open and close the opening, a first laundry treating chamber 11 which is placed in the cabinet 10 and has the receiving space 14 defined therein in which the laundry P is accommodated, the machine chamber 20 in communication with the first laundry treating chamber 11 and configured to supply at least one of air or moisture to the receiving space 14, and an ironing presser 60 disposed in at least one of the first laundry treating chamber 11 or the door assembly 100 and configured to press the laundry. FIG. 11 shows a case where the ironing presser is placed in the door assembly. However, the ironing presser may be placed in the first laundry treating chamber rather than the door assembly. Herein, a description will be made of the case where the ironing presser is disposed in the door assembly.

The cabinet 10 is configured to form an exterior of the laundry treating apparatus 1000 and may have a height larger than a width. As a result, it is possible to prevent wrinkles from occurring in the laundry P because the laundry P having a large vertical dimension such as a lower garment such as pants is accommodated in the receiving space 14 while the laundry P is not folded.

The cabinet 10 may be made of metal. Alternatively, when the cabinet may maintain a strength thereof, the cabinet is made of resin material such as reinforced plastic.

The first laundry treating chamber 11 may further include an inner body 11*a* located inside the cabinet 10 to define the receiving space 14 therein. The inner body 11*a* may be made of a material which is not deformed or does not have a chemical reaction due to foreign matter discharged from laundry P or hot-air or moisture supplied from the machine chamber 20, and is capable of maintaining a strength. For example, the material may include styrene based resin such as ABS and ASA.

The inner body 11*a* is configured to communicate with the machine chamber 20 at one face or a bottom side of the inner body to receive hot-air or moisture from the machine chamber 20, or to discharge air to the machine chamber 20. To this end, the inner body 11*a* may have a plurality of through-holes 36, 37, and 42 defined therein communicating with the machine chamber 20.

In one example, the cabinet 10 may further include the machine chamber 20 separated from the receiving space 14. The machine chamber 20 may be placed under the receiving space 14 to supply heated air or steam which has relatively density than that of air.

That is, when the air supplied to the receiving space 14 from the machine chamber 20 is heated air or hot-air, and the moisture supplied to the receiving space 14 from the machine chamber 20 is steam, the hot-air or steam may be uniformly supplied into the receiving space 14 without a separate blowing device as long as the machine chamber 20 is positioned below the receiving space 14.

Unlike the door assembly 100 as described in FIG. 3 to FIG. 10, the door assembly 100 in various embodiments described in FIG. 11 to FIG. 17 has a planar shape and is free of the second laundry treating chamber 12 and opens or closes the front opening of the cabinet. That is, the door assembly 100 may be configured to be pivotably coupled to the cabinet 10 to open and close the opening. The door assembly 100 may be configured to shield not only the front face of the inner body 11*a* but also a front face of the machine chamber 20. As a result, the door assembly may prevent the hot-air or moisture supplied to the receiving space 14 from leaking to the outside, as well as may prevent heat generated in the machine chamber 20 from being transferred to the outside.

Because the door assembly 100 is configured to open and close the front face of the inner body 11*a*, the inner face of the inner body 11*a* and the inner face of the door assembly 100 may constitute an outer face of the receiving space 14. The ironing presser 60 may be configured to press the laundry P on both sides thereof to remove wrinkles generated in the laundry P or to form a crease intended by the user in the laundry P.

In other words, the ironing presser 60 may perform ironing, so that the user does not need to additionally perform additional ironing after drying and deodorization of the laundry P are finished.

The ironing presser 60 may press laundry P including upper and lower garments to be subjected to ironing.

Specifically, the ironing presser 60 may include a support body 61 disposed in one of the first laundry treating chamber 11 and the door assembly 100 to support laundry thereon, and a pressing body 62 configured to be pivotably moved toward the support body 61 to press laundry supported on the support body 61. Hereinafter, a case where the ironing presser 60 is disposed in the door assembly 100 will be described. Therefore, the door assembly 100 includes the ironing presser 60. That is, the ironing presser 60 is disposed in the door assembly 100 and thus becomes a part of the door assembly 100.

FIG. 11 shows that the support body 61 is disposed on the inner face of the door assembly 100. Alternatively, when the support body may support one face of the laundry, the support body is disposed on the inner face of the inner body 11*a*.

The support body 61 may be provided in a plate shape such that the laundry is not deformed when one face of the laundry is pressed against the pressing body 62. Specifically, the support body 61 may include a contact plate 612 configured to be in face-contact with the laundry P, and may further include a fixing groove 611 recessed along a longitudinal direction in the contact plate 612 so as to avoid a sewing line disposed in the laundry P or to concentrate an applied force onto both lateral ends of the laundry P.

Thus, when the pressing body 62 presses the support body 61, pressure is concentrated on the contact plate 612 so that the wrinkles of the laundry P are effectively removed, as well as the crease is clearly formed at both lateral ends of the laundry P. Furthermore, unintended wrinkles which may otherwise occur due to the sewing line may be prevented from being formed in the laundry P.

The pressing body 62 may be pivotably coupled to the support body 61, or may be pivotably coupled to the inner face of the inner body 11*a* on which the support body 61 is disposed or to the inner face of the door assembly 100. That is, the pressing body 62 may be coupled to any structure as long as the pressing body 62 may be pivotably moved toward or away from the support body 61.

The pressing body 62 may be pivotably coupled to a connection hinge 80 disposed at one side of at least one of the inner body 11*a,* the door assembly 100, and the support body 61.

That is, the connection hinge 80 may be disposed on the support body 61, or may be disposed on the inner body 11*a* on which the support body 61 disposed or may be disposed on the inner face of the door assembly 100.

The connection hinge 80 may include a first connection hinge 81 pivotably supporting the pressing body 62, and a second connection hinge 82 pivotably supporting the pressing body and disposed under the first connection hinge 81.

The pressing body 62 may further include a pressing plate 622 that is pivotably moved toward the support body 61, and a curved groove 621 that is recessed along the longitudinal direction of the pressing plate 622 so as to avoid a sewing line disposed in the laundry P or to concentrate an applied force onto both lateral ends of the laundry P.

Thus, the pressing body 62 may pivot toward the support body 61 to press the one face of the laundry P, and the support body 61 may press the other face of the laundry P due to an action/reaction to the pressing body.

In one example, the ironing presser 60 may further include an ironing partitioning portion 63 that is disposed between the support body 61 and the pressing body 62 and is pivotably moved toward the support body and the pressing body. Therefore, the door assembly 100 may further include the ironing partitioning portion 63 that is disposed between the support body 61 and the pressing body 62 and is pivotably moved toward the support body and the pressing body.

Specifically, the ironing partitioning portion 63 may include an ironing partitioning body 631 disposed between the support body 61 and the pressing body 62 and pivotably moved toward the support body and the pressing body. The ironing partitioning body 631 may have an area corresponding to an area of each of the pressing body 62 and the support body 61. Accordingly, all of laundry disposed between the pressing body 62 and the ironing partitioning body 631, and laundry disposed between the support body 61 and the ironing partitioning body 631 may be pressed.

The ironing partitioning body 631 may be pivotably coupled to the first connection hinge 81 and the second connection hinge 82 and may be configured to pivot separately from the pressing body 62, or may be configured to pivot integrally with the pressing body 62.

The ironing partitioning body 631 may be configured to pivot toward the support body 61 independently from the pressing body. Alternatively, when the pressing body 62 pivots toward the support body 61, the ironing partitioning body 631 may pivot together with the pressing body 62 toward the support body 61.

Figure 12:
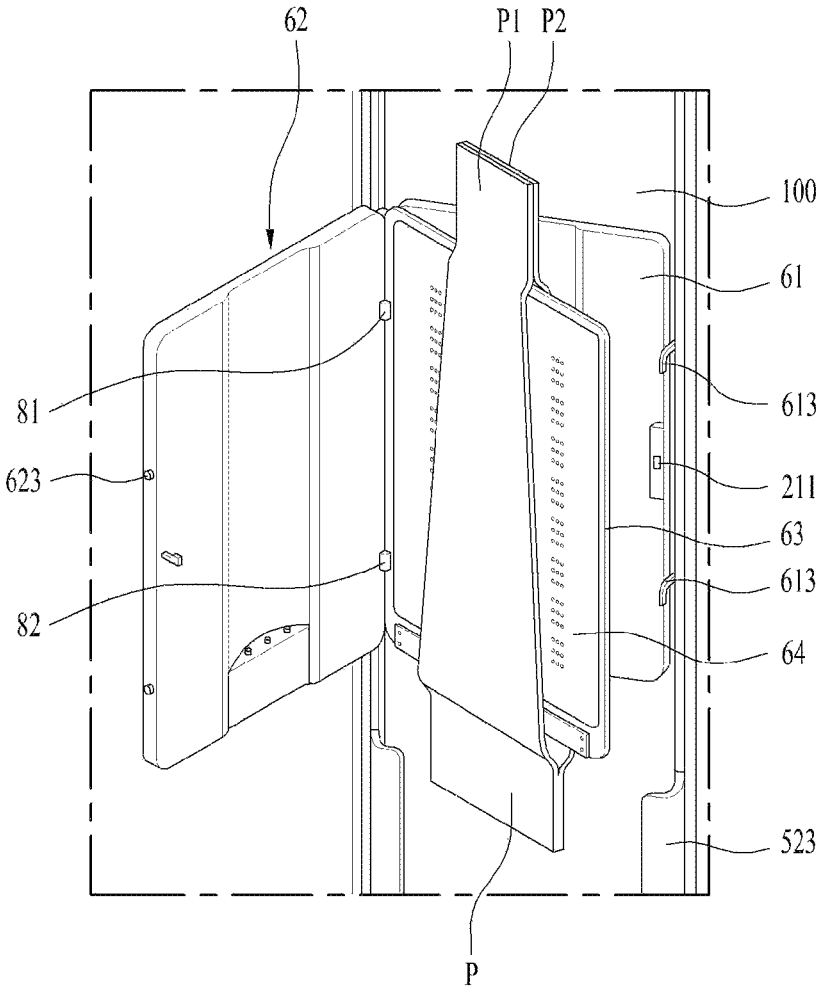
FIG. 12 shows a state in which laundry is held on an ironing presser according to the present disclosure.

FIG. 12 shows an aspect where laundry P is held on and pressed against the ironing presser 60.

Referring to FIG. 12, when the laundry is a lower garment and is divided into a first portion P1 worn on the user's left leg and a second portion P2 worn on the right leg of the user, one of the first portion and the second portion may be pressed against the pressing body 62 and the ironing partitioning body 631, while the other of the first portion and the second portion may be pressed against the ironing partitioning portion 63 and the support body 61.

For example, the first portion P1 and the second portion P2 of the laundry P may be held on a top or bottom of the ironing partitioning body 631, and the first portion P1 may be supported on one face of the ironing partitioning body 631 facing toward the pressing body 62 while the second portion P2 may be supported on the other face thereof facing toward the support body 61.

In this connection, the first portion P1 and the second portion P2 may be held on a top or bottom of the ironing partitioning body 631 in an overlapped manner. Thus, the first portion P1 and the second portion P2 of the laundry may be unfolded due to its own weight, and may not be placed in an overlapped manner. In this way, the first portion P1 and the second portion P2 of the laundry may be accurately pressed such that wrinkles may be removed therefrom or creases may be accurately formed in both lateral ends thereof.

In one example, a laundry holding member 632 protruding from both faces or one face of the ironing partitioning body 631 may be further included.

The laundry holding member 632 may prevent excessive contact of the laundry with the support body 61 and the pressing body 62. When the laundry P is pressed against the pressing body 62 or the ironing partitioning portion 63, the laundry holding member 632 may prevent the position of the laundry from changing.

To this end, the laundry holding member 632 may be made of a material having a higher friction than that of the ironing partitioning body 631, or having a shock absorbing ability.

The ironing partitioning portion 63 having a certain thickness and the laundry are disposed between the support body 61 and the pressing body 62. Thus, there is a concern that even when the pressing body 62 presses the laundry, the pressing body 62 may pivot in an opposite direction to a direction toward the support body 61 due to a reaction to the pressing.

Therefore, in order to prevent this situation, the laundry treating apparatus 1000 according to the present disclosure may further includes a coupling hook 613 disposed on the support body 61 to fix the pressing body thereto, and a hook coupler 623 disposed on the pressing body and coupled to the coupling hook.

In an example, the hook coupler 623 may include a hook protrusion 623 protruding from a lateral face of the pressing plate 622, and the coupling hook 613 may have a hook shape so as to be engaged with the hook protrusion 623.

Further, unlike shown in FIG. 12, the coupling hook 613 may be configured to be inserted into and fastened to the hook coupler 623. As long as the support body 61 is coupled to the pressing body 62 such that a state in which the pressing body 62 presses the ironing partitioning portion 63 and the support body 61 is maintained, the coupling hook 613 and the hook coupler 623 may have any coupling structure.

FIG. 12 shows that the laundry is one lower garment. However, this is only an example. A plurality of garments may be held on the ironing presser 60. In other words, when the laundry is a plurality of garments, one garment may be disposed between the ironing partitioning portion 63 and the pressing body 62, while another garment may be disposed between the ironing partitioning portion 63 and the support body 61. Further, in an embodiment to be described later, a plurality of ironing partitioning portions may be provided so that garments may be respectively disposed therebetween.

Accordingly, when the pressing body 62 pivots toward the support body 61, the pressing body 62 presses one garment against the ironing partitioning body 631, and the ironing partitioning body 631 may press another garment against the support body 61.

Therefore, pressing all of the plurality of garments using one ironing presser 60 may allow removing wrinkles or forming the crease.

Furthermore, when the laundry is an upper garment, the garment contacts the outer circumferential face of the ironing partitioning body 631 and encloses the ironing partitioning body 631 therein. Thus, one face and the other face of the garment are simultaneously pressed against the pressing body 62 and the support body 61.

In one example, when the ironing partitioning portion 63 is provided between the support body 61 and the pressing body 62, moisture or hot-air supplied from the machine chamber 20 may not be supplied to the laundry therebetween. Therefore, the ironing presser 60 may require a separate component capable of supplying heat or steam to the laundry P.

In one example, the support body 61 may include a coupler 311 capable of detachably coupling the ironing partitioning body 631 thereto. The coupler 311 may be embodied in a hook manner such that a portion of an outer peripheral face of the ironing partitioning body 631 is inserted into the coupler, and may be configured such that a fastening portion disposed on the pressing body 62 may be simultaneously coupled to the coupler.

Figure 13:
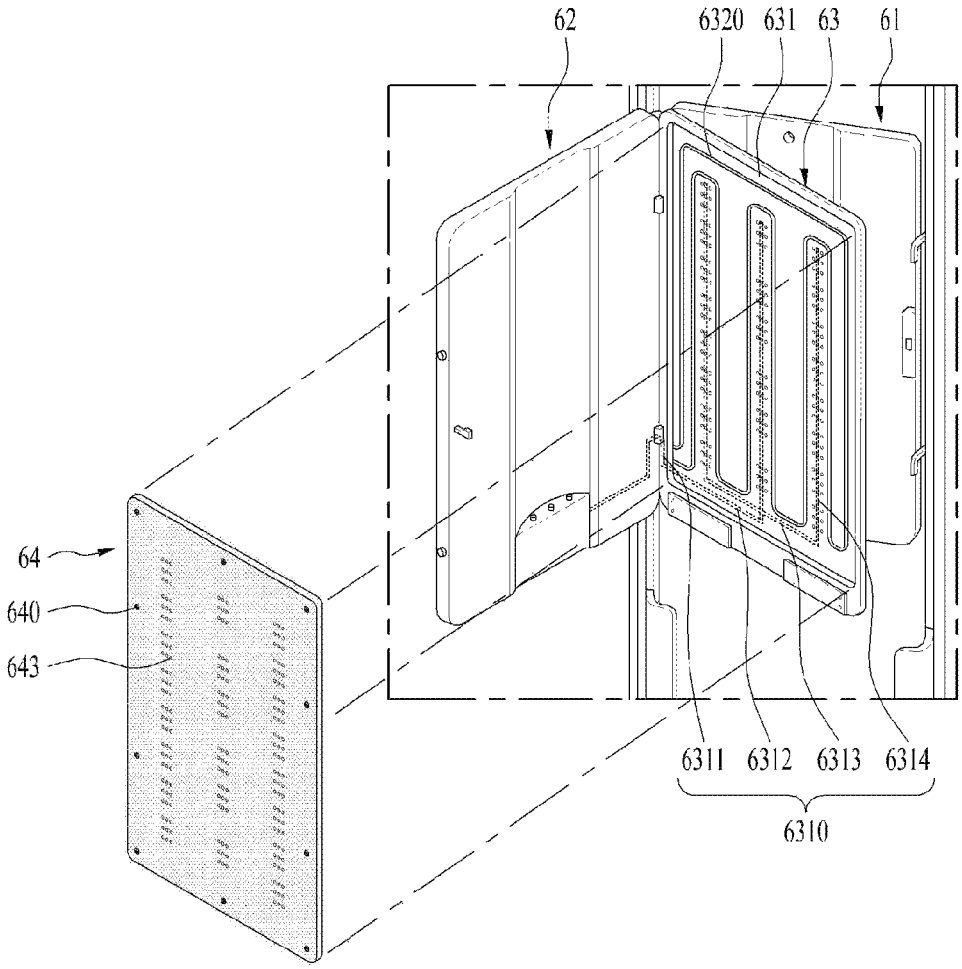
FIG. 13 shows an embodiment of a heater installed in an ironing presser according to the present disclosure.

FIG. 13 shows a structure in which heat or steam may be separately supplied to the ironing presser 60. Referring to FIG. 13, the ironing partitioning portion 63 according to the present disclosure may further include a heater 64 disposed on at least one of both faces of the ironing partitioning body 631 and configured to supply heat to the laundry.

The heater 64 may be configured to effectively remove wrinkles or effectively generate creases by supplying heat energy to the laundry pressed between the ironing partitioning portion 63 and the support body 61 and to the laundry pressed between the pressing body 62 and the ironing partitioning portion 63.

The heater 64 may include a heating body 640 disposed on at least one of both faces of the ironing partitioning body 631 and exposed to the outside, and a heating wire 6320 disposed in one of the ironing partitioning body 631 and the heating body 631 to heat the heating body 640.

The heating body 640 may be made of a conductor or a metal material so as to transfer heat well, and the heating wire 6320 may be configured to transfer heat to the heating body 640 while being heated with electric energy or the like.

The heating body 640 may be detachably coupled to both faces of the ironing partitioning body 631 to form exposed faces of the ironing partitioning body 631. That is, a heating body coupled to one face closer to the inner face of the door assembly 100 among both faces of the ironing partitioning body 631 is a first heating body 6411, while a heating body disposed on the other face of the ironing partitioning body 631 is a second heating body 6412.

In another example, when the heating body and the fixing body are made of the same material, the heating body 640 may be formed integrally with the ironing partitioning body 631.

The heating wire 6320 may be attached to a rear face of the heating body 640. However, a configuration in which the heating wire 6320 is disposed on the ironing partitioning body 631 may be more advantageous for safety. In other words, the heating wire 6320 on the ironing partitioning body 631 may be configured to be spaced apart from the heating body 640 by a predetermined spacing to indirectly heat the heating body 640.

The heating wire 6320 may be configured to receive electrical energy from the cabinet 10 or the machine chamber 20 of the laundry treating apparatus 1000 according to the present disclosure, and may be connected to the outside of the ironing presser 60 via the first connection hinge 81 or the second connection hinge 82. The heating wire 6320 may be evenly installed on both sides of the ironing partitioning body 631 while extending in a reciprocating manner a plurality of times in a height direction and a width direction so as to evenly supply heat to one face of the heating body 640.

In one example, the heater 64 may include a supply channel 6310 that is defined in one of the ironing partitioning body 631 and the heating body 640 to supply steam, and a plurality of discharge holes 643 configured to pass through the heating body 640 and discharge the steam to the laundry.

Water may be supplied to the supply channel 6310, and may be heated by the heating wire 6320 and may be converted to the steam which in turn may be discharged to the discharge hole 643. Alternatively, the steam or mist may be directly supplied to the supply channel 6310.

The supply channel 6310 may include a plurality of channels which are arranged and spaced from each other by a predetermined spacing along a height direction or a width direction of the ironing partitioning body 631. The discharge hole 643 may include a plurality discharge holes which may be arranged along the extending direction of the supply channel 6310. Accordingly, steam may be evenly supplied to laundry P through the discharge hole 643.

The heater 64 may include only one of the supply channel 6310 and the heating wire 6320 or may include both the supply channel 6310 and the heating wire 6320.

In one example, when the heater 64 include both the supply channel 6310 and the heating wire 6320, the heating wire 6320 may be disposed outside the supply channel 6310 so as not to interfere with the supply channel 6310. Further, the heating wire 6320 may extend to surround the supply channel 6310.

Further, the ironing partitioning portion 63 is pivotably disposed in the first laundry treating chamber 11 or the door assembly 100. Thus, an installation area of a channel for supplying steam to the supply channel 6310 may be limited.

The supply channel 6310 may include a main channel 6312 defined in the ironing partitioning body 631 or disposed on a surface of the ironing partitioning body 631, a plurality of branched channels 6313 branched from the main channel 6312 in in the height direction or the width direction of the ironing partitioning body 631, and a plurality of spray channels 6314 extending in the same direction from the branched channel 6313 to supply steam to the laundry P.

In this connection, steam has lower density. Thus, each of the plurality of spray channels 6314 preferably extends in the height direction to facilitate movement of the steam. It is preferable that the spray channels 6314 are arranged and spaced apart from each other in the width direction so that steam may be sprayed onto a larger area.

Accordingly, when steam, moisture, or water is supplied only to the main channel 6312, the steam, moisture or water may be distributed along the spray channels 6314 so that steam may be evenly sprayed from the ironing partitioning body 631 to the laundry.

The supply channel 6310 may further include a communication channel 6311 configured to communicate with an auxiliary steam supply 85 disposed outside the ironing partitioning body 631 and to deliver water or steam to the main channel 6312.

In one example, the heating wire 6320 is configured to communicate with one of the first connection hinge 81 and the second connection hinge 82, while the main channel 6311 is configured to communicate with the other of the first connection hinge 81 and the second connection hinge 82, so that the heating wire and the main channel may not overlap each other.

To this end, passages 811 and 821 through or with which the heating wire or the main channel 6311 may pass or communicate may be defined in the first connection hinge 81 and the second connection hinge 82, respectively.

Figure 14:
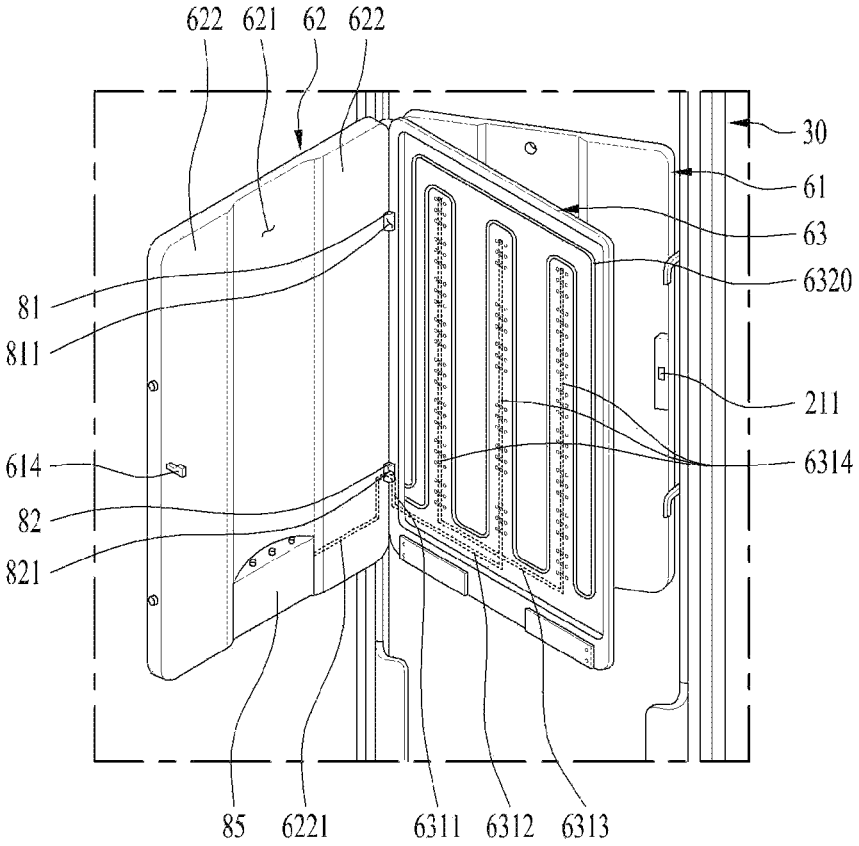
FIG. 14 shows an embodiment of a channel structure of a heater in accordance with the present disclosure.

FIG. 14 shows a structure in which the auxiliary steam supply 85 is installed to supply steam.

The auxiliary steam supply 85 may be disposed in an area easily accessible to a user of the cabinet, the machine chamber 20, the door, or the presser.

The auxiliary steam supply 85 may be disposed on at least one of the cabinet, the machine chamber 20, the door, and the presser. Because the laundry treating apparatus 1000 may not be connected to an external water supply source, the auxiliary steam supply 85 is preferably disposed detachably on at least one of the cabinet, the machine chamber 20, the door, and the presser.

Further, because the auxiliary steam supply 85 is advantageously disposed in a region closest to the supply channel 6310, it is preferable that the auxiliary steam supply 85 is disposed on the ironing partitioning portion 63. Alternatively, because the pressing body 62 is first exposed to the user, it is preferable that the auxiliary steam supply 85 is disposed on the pressing body 62.

When the auxiliary steam supply 85 is detachably installed on the pressing body 62, the pressing body 62 may further include a connection channel 6221 configured to communicate the auxiliary steam supply 85 with the connection hinge 80.

The connection channel 6221 has a tubular shape. The moisture or steam supplied from the auxiliary steam supply 85 thereto may be discharged from the connection channel 6221. The connection channel 6221 may be defined in the pressing body 62.

Thus, the connection channel 6221 and the communication channel 6311 may communicate with each other through the second connection hinge 82, so that moisture or steam generated from the auxiliary steam supply 85 may be completely discharged to the discharge hole 643.

In one example, the supply channel 6310 defined in the ironing partitioning body 631. The ironing partitioning body 631 may have a plurality of through holes configured to communicate with the discharge holes 643 of the heater 64.

Thus, the supply channel 6310 is not disposed on each of both faces of the ironing partitioning body 631, but is defined inside the ironing partitioning body 631, a thickness of the ironing partitioning body 631 may be reduced. Further, there is an advantage that steam may be supplied to both faces of the ironing partitioning body 631 through one supply channel 6310.

Figure 15:
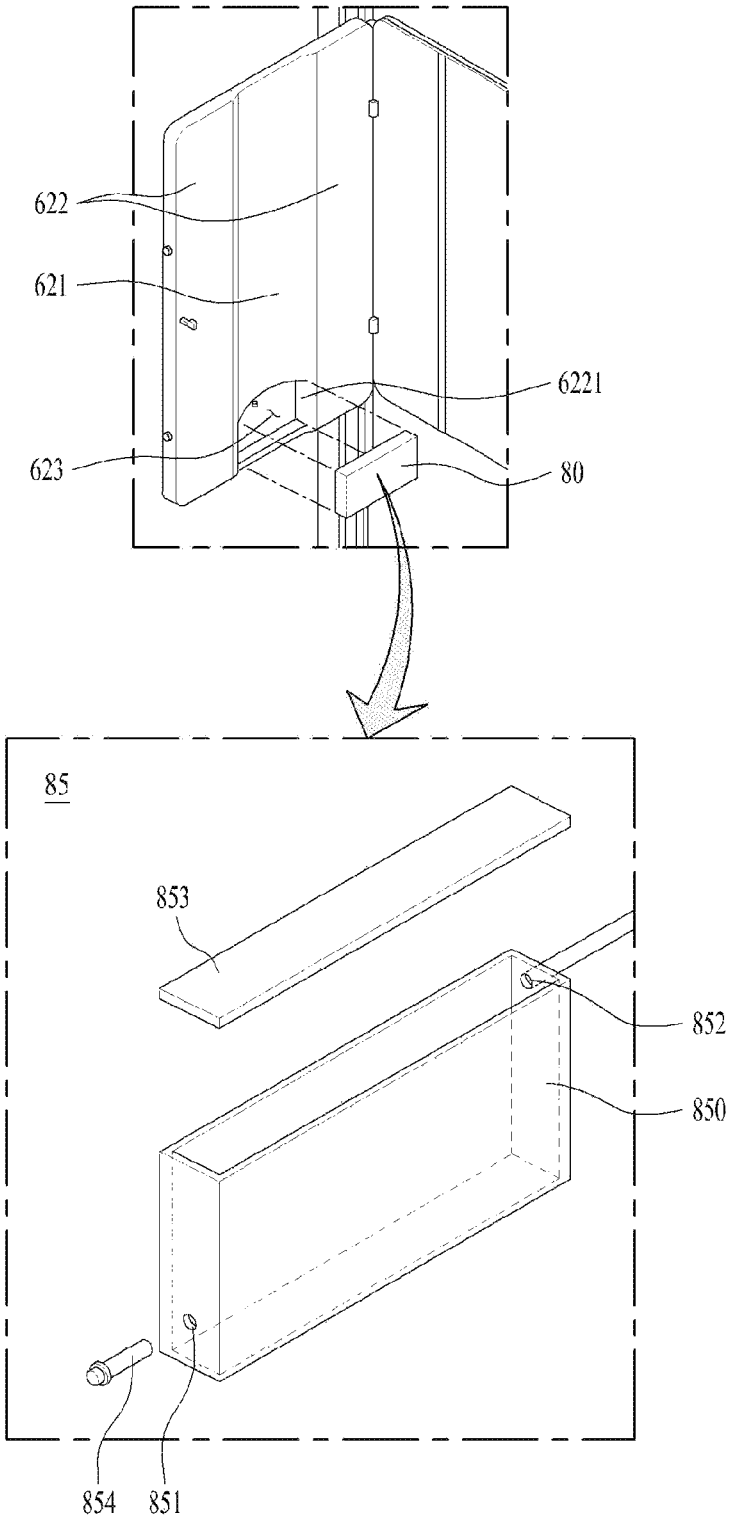
FIG. 15 shows an embodiment of a moisture supply structure of a heater in accordance with the present disclosure.

FIG. 15 shows an embodiment of the auxiliary steam supply 85. As described above, the auxiliary steam supply 85 may be detachably disposed into the pressing body 62.

The auxiliary steam supply 85 may include an auxiliary water tank 850 detachably disposed into at least a portion of the presser and receive water therein, an auxiliary heater 854 that generates steam by heating water in the auxiliary water tank 850, and a discharge hole 852 for communicating the auxiliary water tank 850 and the supply channel 6310 with each other and discharging steam to the supply channel 6310.

The auxiliary water tank 850 may have a case shape having a certain volume, and may have an open top face so as to easily receive water or to facilitate cleaning. The auxiliary water tank 850 may further include a cover 853 configured to shield the top open face.

Further, the auxiliary water tank 850 may have a heater receiving hole 811 defined in a side face thereof into which the auxiliary heater 854 is inserted in a fixed manner. The auxiliary heater 854 may be configured to be inserted into the heater receiving hole 811 in a fixed manner to heat water accommodated in the auxiliary water tank 850 to generate the steam.

The discharge hole 852 may be defined at a top of one side face of the auxiliary water tank 850 so that the steam having a relatively low density may be completely discharged therethrough. The discharge hole 852 may be configured to communicate with the connection channel 6221.

The pressing body 62 may further have a tank receiving space 623 defined therein configured to accommodate the auxiliary water tank 850 therein. Further, when the auxiliary water tank 850 is received in the tank receiving space 623, an exposed face of the auxiliary water tank 850 and one face of the pressing body 62 may constitute the same face.

Accordingly, when water is supplied to the auxiliary water tank 850, steam may be supplied to the laundry P through the heater 64.

In one example, unlike shown in the drawing, the heater 64 may be configured to communicate with the machine chamber 20 or the auxiliary water tank 850 to receive hot-air or moisture directly therefrom, and to discharge the hot-air or moisture toward the pressing body 62 and the support body 61.

In other words, the heater 64 may be formed integrally with the ironing partitioning body 631 and may have the discharge hole 643 for discharging the hot-air and moisture.

Each of the first connection hinge 81 and the second connection hinge 82 may have a channel communication with the machine chamber 20. The ironing partitioning body 631 may have a supply channel defined therein communicating with the channel defined in each hinge to supply hot-air or moisture to the heater 64.

The heater 64 communicates with the machine chamber 20. In this case, when the hot-air or moisture from the machine chamber 20 is supplied to the receiving space 14, the hot-air or moisture from the machine chamber 20 may be supplied to the heater 64.

Alternatively, the steam generator 41 of the machine chamber 20 may be configured to communicate with the ironing partitioning portion 63 and supply steam thereto.

That is, as in FIG. 8 or FIG. 10, the steam generator 41 may be configured to communicate with a separate steam supply channel configured to communicate with the ironing partitioning portion 63 through the connection hinge 80. The steam supply pipe 417 may be branched to communicate with the ironing partitioning portion 63 through the passage 811 defined in the connection hinge 80.

Accordingly, the steam generated from the steam generator 41 may be directly delivered to the ironing partitioning portion 63 which may supply the steam to the laundry P. In this case, the heating wire 6320 and the auxiliary steam supply 85 may be omitted.

Figure 16:
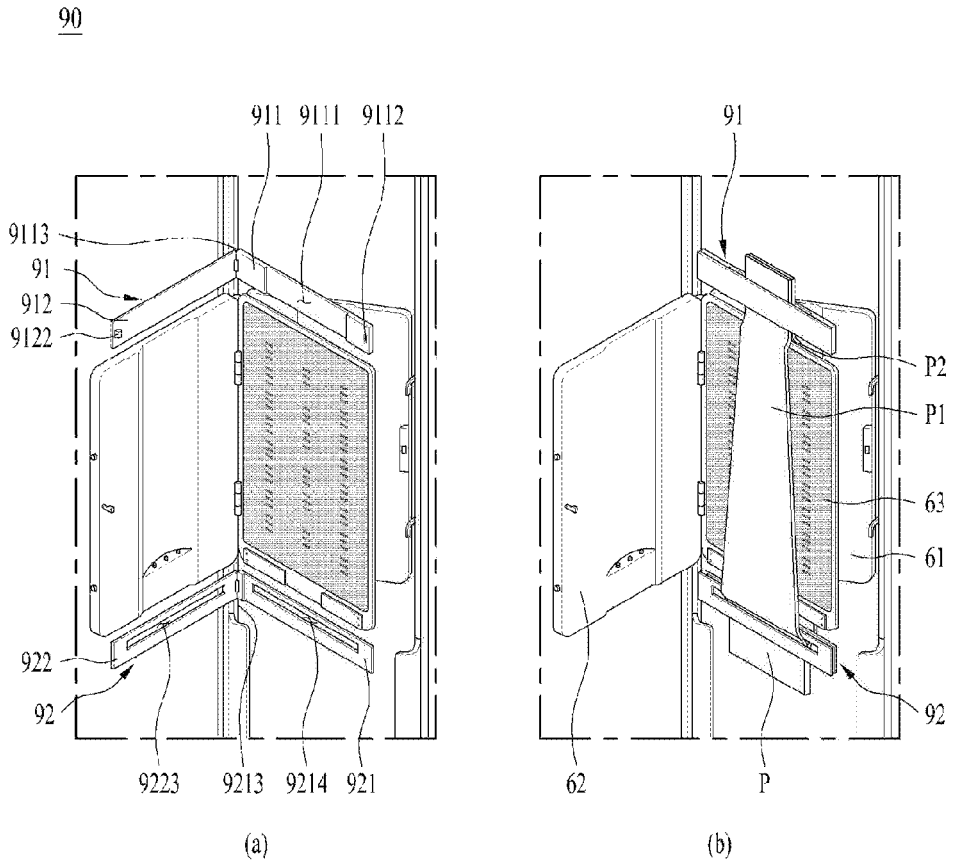
FIG. 16 shows a structure of a laundry hanger that holds laundry on an ironing presser according to the present disclosure.

FIG. 16 shows a structure of a laundry hanger that fixes laundry to the ironing presser 60.

(a) in FIG. 16 shows that the laundry is separated from the ironing presser 60, and (b) in FIG. 16 shows that the laundry is held on the ironing presser 60.

The laundry treating apparatus 1000 according to the present disclosure may further include a laundry hanger 90 disposed above and/or under the ironing presser 60 to hold or fix the laundry thereon or thereto. A position of the laundry hanger 90 may be defined relative to the support body 61, the pressing body 62, and the ironing partitioning portion 63. That is, the laundry hanger 90 may be disposed above and/or under one of the support body 61, the pressing body 62, and the ironing partitioning portion 63.

The laundry hanger 90 may include hanger bodies 911 and 921 disposed above and/or under the presser to support the laundry thereon, and fixing bodies 912 and 922 that are respectively coupled to the hanger bodies to fix the laundry to the hanger bodies.

Each of the hanger bodies 911 and 921 may maintain the laundry P in a fully stretched state to prevent the laundry from being wrinkled or being displaced when the laundry is pressed against the presser 60.

In this connection, when the laundry hanger 90 is in a fixed state while the partitioning portion 63 is pivoting, the laundry may be damaged. Thus, the hanger bodies 911 and 921 may be configured to pivot together with the pivoting of the partitioning portion 63.

Further, the fixing bodies 912 and 922 may be pivotably coupled to the hanger bodies 911 and 921 respectively, so that the laundry is fitted between each of the fixing bodies 912 and 922 and each of the hanger bodies 911 and 921 in a fixed manner.

Each of the hanger bodies 911 and 921 may be coupled to each of the fixing bodies 912 and 922 in a hook coupling manner, thereby to prevent the laundry P from being removed therefrom. For example, each of the hanger body 911 and 921 may have a hook coupler 9112, while each of the fixing bodies 912 and 922 may have a coupling hook 9122 to which a corresponding coupling hook is coupled.

In one example, the laundry hanger 90 may be installed only above the ironing presser 60 to fix the laundry P thereto, so that the laundry P may be in a fully stretched manner via its own weight.

However, when the ironing presser 60 applies a relatively large force for pressing the laundry P, or when pressing in a direction from one side of the laundry P to the other side thereof, the position of the laundry P may be changed or the laundry P may be wrinkled.

Thus, the laundry hangers 90 may be respectively disposed above and under the ironing presser 60 to apply sufficient tension to the laundry P, thereby preventing the laundry P from being wrinkled or displaced.

Referring to (a) in FIG. 16, the laundry hanger 90 may include a first laundry hanger 91 disposed above the ironing presser 60 and a second laundry hanger 92 disposed below the ironing presser 60.

The first laundry hanger 91 and the second laundry hanger 92 may be configured to pivot together with the ironing partitioning portion 63.

The first laundry hanger 91 may include a first hanger body 911 pivotably disposed above the ironing partitioning portion 63 and a first fixing body 912 pivotably coupled to the first hanger body 912 to fix the laundry to the first hanger body.

The first hanger body 911 may be embodied as a plate having a length larger than a width thereof. The first fixing body 912 may be pivotably coupled to the first hanger body 911, but a free end thereof may be configured to be detachably coupled to the first hanger body 911.

The first hanger body 911 may further have a receiving groove 9111 to accommodate the laundry therein. One face of the groove 9111 may be curved. Therefore, the laundry may be prevented from being excessively pressed.

In one example, the second laundry hanger 92 may include a second hanger body 921 pivotably disposed under the ironing partitioning portion 63, and a second fixing body 922 that is pivotably coupled to the second hanger body to fix the laundry to the second hanger body.

The second hanger body 921 may have a first through-slit 9214 defined therein through which a first portion of the laundry P passes. The second fixing body 922 may have a second through-slit 9223 defined therein through which a second portion of the laundry passes.

Accordingly, the first portion P1 and the second portion P2 of the laundry may be inserted into the first through-slit and the second through-slit respectively and may be guided along both side faces of the partitioning portion 63 respectively in a divided manner.

Therefore, referring to (b) in FIG. 16, the first portion P1 of the laundry P may be inserted into the second through-slit 9223 and guided between one face of the ironing partitioning portion 63 and the pressing body 6, while the second portion P2 of the laundry P may be inserted into the first through-slit 9214 and guided between the other face of the ironing partitioning portion 63 and the support body 61.

Further, the first portion P1 and the second portion P2 of the laundry may overlap each other in a region above the ironing presser 60 and may be inserted between the first hanger body 911 and the first fixing body 912 in a fixed manner.

In this connection, the first portion P1 of the laundry, and the second portion P2 may be inserted between the first hanger body 911 and the first fixing body 912 in a fixed manner while being in a fully stretched tight state.

Unlike shown in the drawing, the first laundry hanger 91 may have a through-slit defined therein. The second laundry hanger 92 may have a laundry receiving groove defined therein. Accordingly, the user may adjust the hanging direction of laundry P as necessary.

Figure 17:
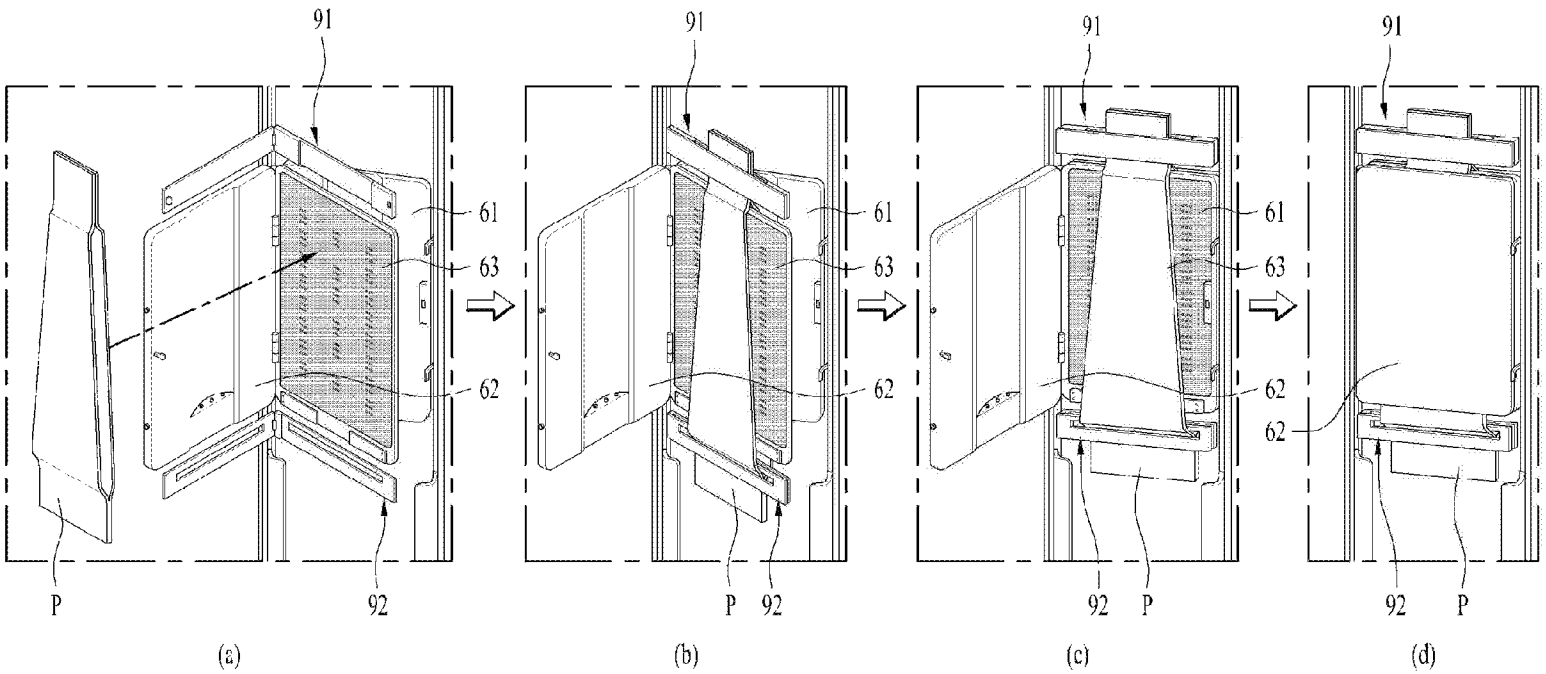
FIG. 17 shows, step by step, a process of placing laundry on an ironing presser and a laundry hanger according to the present disclosure.

FIG. 17 shows a process in which laundry P is held in the laundry treating apparatus 1000 according to an embodiment of the present disclosure.

Referring to (a) in FIG. 17, the first fixing body 921 and the first hanger body 911 may be separated from each other, and the second fixing body 922 and the second hanger body 921 FIG. may be in a separate state from each other. Further, the pressing body 62, the support body 61, and the ironing partitioning portion 63 may be separated from each other.

Referring to (b) in FIG. 17, the user may insert the first portion P1 and the second portion P2 of the laundry P into the through-slits defined in the second hanger body 921 and the second fixing body 921, respectively. The user may place the first portion P1 to be disposed between the ironing partitioning portion 63 and the pressing body 62, and place the second portion P2 to be disposed between the ironing partitioning portion 63 and the support body 61.

Then, the user may overlap the free ends of the first portion P1 and the second portion P2 of the laundry P each other and may pull the free ends upwardly such that the laundry is in a fully stretched tight state. In this state, the first portion P1 and the second portion P2 of the laundry P in the overlapped sate may be fixed to the first hanger body 911 and the second fixing body 921 in the fully stretched tight state.

Referring to (c) in FIG. 17, the first laundry hanger 91, the second laundry hanger 92, and the ironing partitioning portion 63 pivot toward the support body 61. In this connection, the support body 61 and the ironing partitioning portion 63 are coupled to each other to prevent separation therebetween.

Referring to (d) in FIG. 17, the user may pivot the pressing body 62 toward the support body 61 such that the ironing partitioning portion 63 is pressed against the laundry. Thereafter, the pressing body 62 and the support body 61 are coupled to each other to prevent unintentional separation therebetween.

Thus, both the first portion P1 and the second portion P2 of the laundry P are pressed against the ironing partitioning portion 63. In this connection, when heat and steam are supplied from the heater 64 to the laundry, wrinkles are removed from the first portion P1 and the second portion P2 of the laundry P and the crease is formed in the first portion P1 and the second portion P2 of the laundry P.

Figure 18:
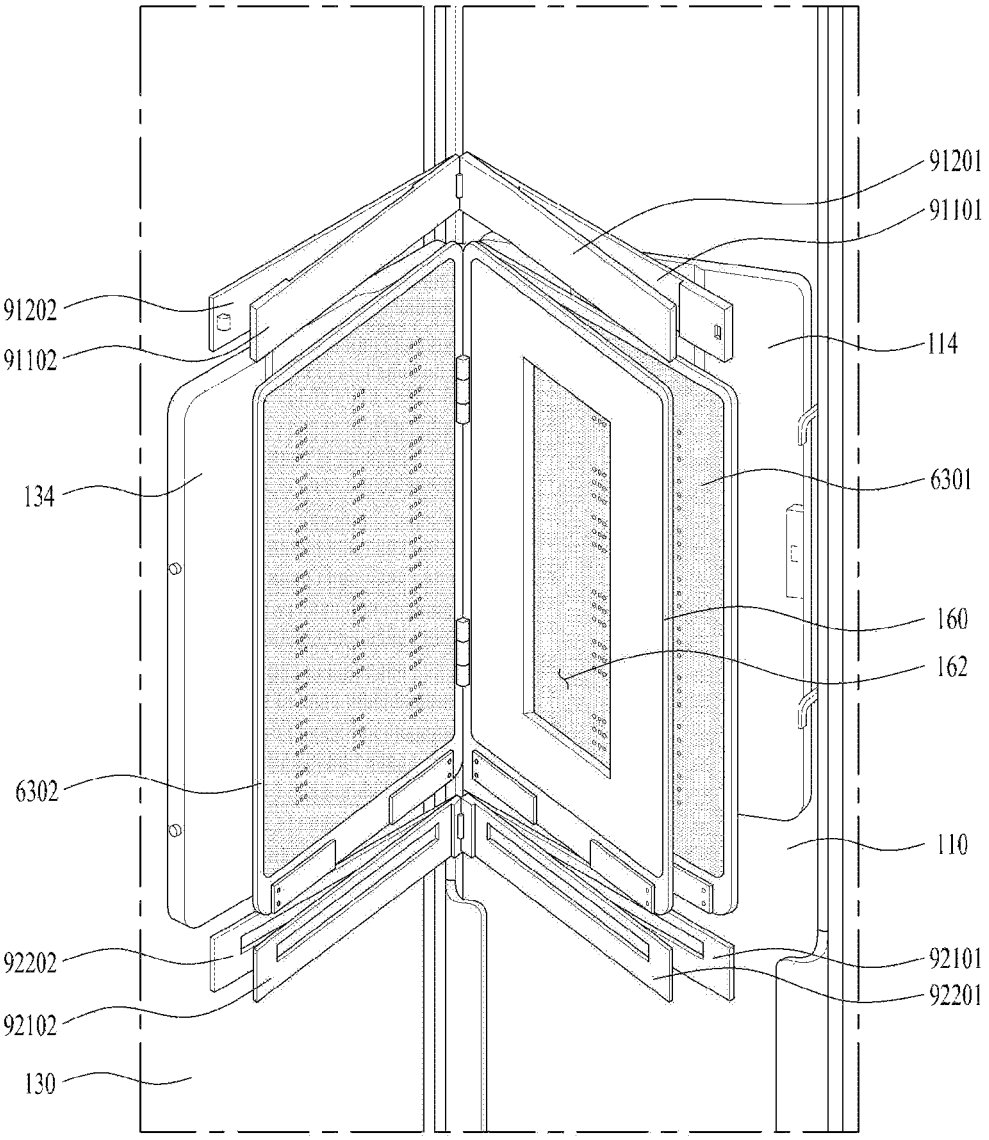
FIG. 18 is a diagram for describing arrangement of a first panel, a second panel, a partitioning plate, a plurality of ironing partitioning portions, and a plurality of laundry hangers arranged in a door assembly according to an embodiment of the present disclosure.

FIG. 18 shows another embodiment of the present disclosure. The door assembly 100 includes the first panel 110 and the second panel 130 and the partitioning plate 160 interposed therebetween. Further, a first ironing partitioning portion 6301 and a second ironing partitioning portion 6302 are disposed between the first panel 110 and the partitioning plate 160, and between the partitioning plate 160 and the second panel 130, respectively.

The first base plate 114, the first ironing partitioning portion 6301, the partitioning portion 160, the second ironing partitioning portion 6302 and the second base plate 134 disposed on the inner face 111 of the first panel are pivotably coupled to each other at one side thereof via the connection hinge 80. That is, the connection hinge 80 may be disposed on the first base plate 114, and may be disposed on the inner face 111 of the first panel 110 on which the base plate 114 is disposed.

Further, the connection hinge 80 may include the first connection hinge 81 disposed on the top of the first base plate to pivotably retain the first ironing partitioning portion 6301, the partitioning portion 160, the second ironing partitioning portion 6302 and the second base plate 134, and the second connection hinge 82 disposed on the bottom of the first base plate to pivotably retain the first ironing partitioning portion 6301, the partitioning portion 160, the second ironing partitioning portion 6302, and the second base plate 134.

The second base plate 134 may be fixed to the second panel 130 and thus may be coupled to the second ironing partitioning portion 6302 and the partitioning portion when the second panel pivots. In this case, the connection hinge 80 pivotably retains only the first base plate 114, the first ironing partitioning portion 6301, the partitioning portion 160, and the second ironing partitioning portion 6302.

In this case, as in FIG. 14, the auxiliary steam supply 85 for the steam supply may be installed. The auxiliary steam supply 85 is preferably disposed detachably on at least one of the cabinet 10, the machine chamber 20, and the door assembly 100. That is, as in FIG. 14, the auxiliary steam supply 85 may be disposed on the second base plate 134 to supply steam to the first ironing partitioning portion 6301 and the second ironing partitioning portion 6302 through the communication channel. The heating wire may extend to surround an outer periphery of the supply channel such that interference of the wire with the supply channel to supply the steam to each of the first and second ironing partitioning portions is prevented. Further, the ironing presser may include a connection hinge that pivotably couples the ironing partitioning portion and the support body with each other, and a passage defined in the connection hinge through which the heating wire or the supply channel passes.

Alternatively, the steam generator 41 of the machine chamber 20 may be configured to communicate with the ironing partitioning portion 63 to supply steam thereto.

That is, as in FIG. 8 or FIG. 10, the steam generator 41 may be connected to a separate steam supply channel configured to pass through the cabinet hinge 174 and the assembly hinge 176, and to communicate with the first ironing partitioning portion 6301 and the second ironing partitioning portion 6302 through the connection hinge 80 that connects the first ironing partitioning portion 6301 and the second ironing partitioning portion 6302 with each other. The steam supply pipe 417 may be branched to communicate with the first ironing partitioning portion 6301 and the second ironing partitioning portion 6302 through the passage 811 defined in the connection hinge 80 connecting the first ironing partitioning portion 6301 and the second ironing partitioning portion 6302 with each other.

Accordingly, the steam generated from the steam generator 41 may be directly delivered to the ironing partitioning portion 63 which in turn may supply the steam to the laundry P. In this connection, the heating wire 6320 and the auxiliary steam supply 85 may be omitted.

In order to hold the laundry held on the first ironing partitioning portion 6301 and the laundry held on the second ironing partitioning portion 6302, the laundry hanger may include a first right hanger body 91101 and a first right fixing body 91201 disposed above the first ironing partitioning portion 6301; a first left hanger body 91202 and a first left fixing body 91202 disposed above the second ironing partitioning portion 6302; a second right hanger body 92101 and a second right fixing body 92201 disposed below the first ironing partitioning portion 6301; and a second left hanger body 92102 and a second left fixing body 92202 disposed below the second ironing partitioning portion 6302. This configuration is intended to hold the laundry held on the first ironing partitioning portion 6301 and the laundry held on the second ironing partitioning portion 6302, respectively. Detailed descriptions of this embodiment other than the above description of the intended configuration are the same as the descriptions based on FIG. 16 and FIG. 17, and thus, may be omitted.

Figure 19:
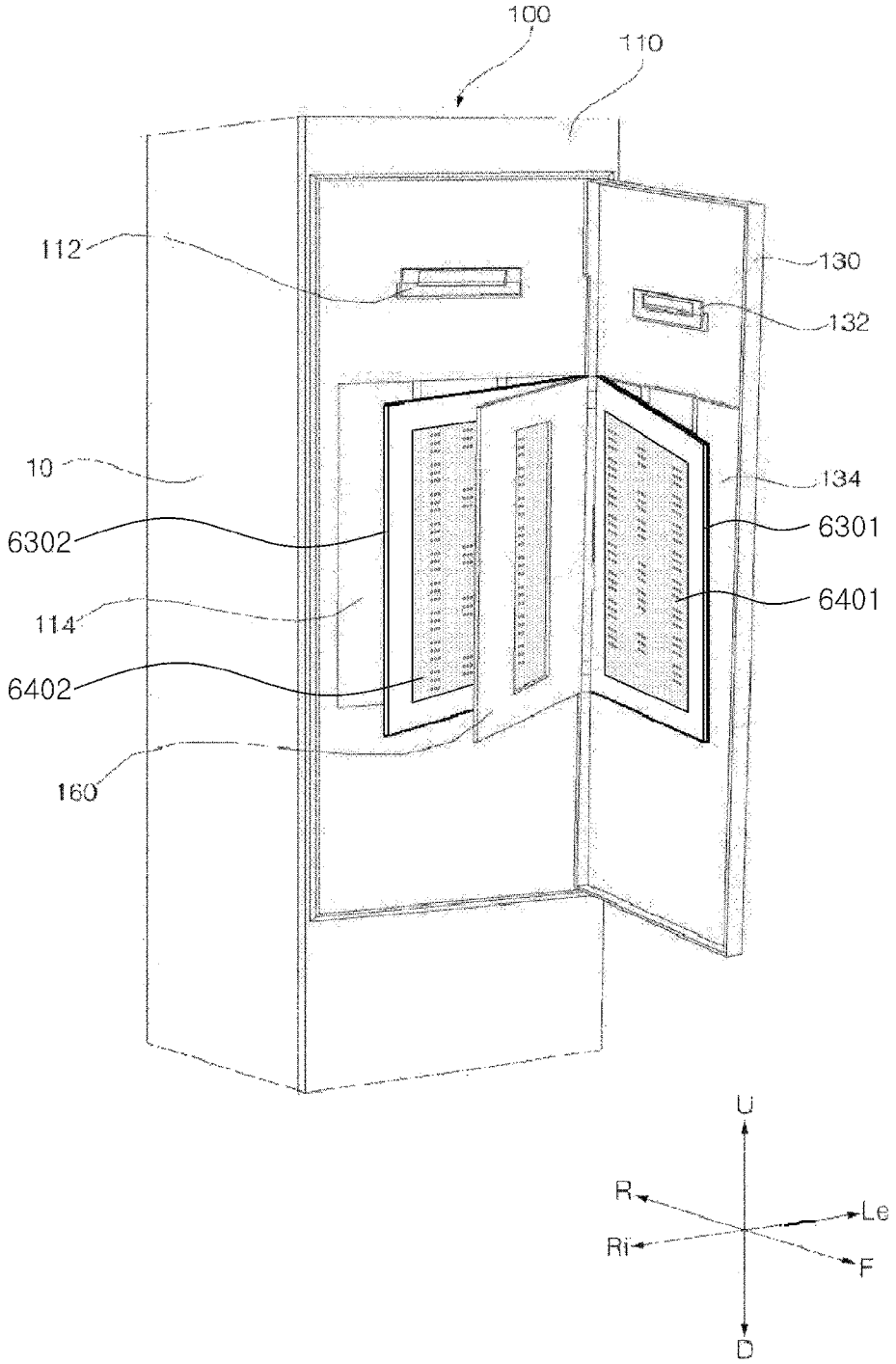
FIG. 19 is a diagram for describing a laundry treating apparatus including arrangement of a first panel, a second panel, a partitioning plate, a plurality of ironing partitioning portions, and a plurality of laundry hangers arranged in a door assembly according to another embodiment of the present disclosure.

Referring to FIG. 19, the laundry treating apparatus 1000 according to an embodiment may have a structure in which the second panel 130 is opened to the outside of the first panel 110.

The laundry treating apparatus 1000 according to this embodiment includes the first panel 110 which is pivotably connected to the cabinet 10, the second panel 130 pivotably connected to the first panel 110, and the partitioning plate 160 that is disposed between the first panel 110 and the second panel 130 and press laundry disposed on each of both side faces thereof. Further, the first ironing partitioning portion 6301 and the second ironing partitioning portion 6302 are disposed between the first panel 110 and the partitioning plate 160, and between the partitioning plate 160 and the second panel 130, respectively.

The first panel 110 according to this embodiment opens and closes the open front face of the cabinet 10. The second panel 130 according to this embodiment is disposed in front (F) of the first panel 110.

The door assembly 100 according to the present embodiment may open and close only the second panel 103 while the door assembly 100 closes the cabinet 10. Therefore, even when the laundry is being treated in the first laundry treating chamber 11, the second laundry treating chamber 12 may be opened to treat laundry such as pants therein via pressurization. Detailed descriptions of this embodiment other than the above description of the above intended difference are the same as the descriptions based on FIG. 9 and FIG. 18, and thus, may be omitted.

The preferred embodiments of the present disclosure have been shown and described above. However, the present disclosure is not limited to the specific embodiments as described above. Various modifications may be implemented by those with ordinary knowledge in the technical field without departing from the gist of the present disclosure claimed in the Claims. The modifications should not be understood individually based on the technical idea or perspective of the present disclosure.

The invention claimed is:

1. A laundry treating apparatus comprising:

a cabinet having a front opening;

a door assembly configured to open and close the front opening;

a first laundry treating chamber defined in the cabinet and configured to receive laundry therein, wherein the first laundry treating chamber communicates with an outside of the cabinet through the front opening; and a machine chamber in communication with the first laundry treating chamber, wherein the machine chamber receives therein at least one of a steam supply to supply steam to the first laundry treating chamber and an air supply for circulating air, wherein the door assembly includes:

a first panel having a second laundry treating chamber defined therein to treat laundry therein, wherein one face of the first panel is open, and the first panel is pivotably connected to the cabinet, the laundry including a first laundry and a second laundry, a second panel pivotably connected to the first panel and configured to open and close the open one face of the first panel, a fixing portion that is disposed at at least one of the first panel or the second panel and that is configured to hold the first laundry and the second laundry, and a partitioning plate disposed between the first panel and the second panel, the partitioning plate being configured to press the first laundry between the first panel and the partitioning plate and to press the second laundry between the second panel and the partitioning plate.

2. The apparatus of claim 1, wherein one side of the partitioning plate is hinge-coupled to one side of the first panel or the second panel, wherein the other side of the partitioning plate is removably coupled to the other side of the first panel or the second panel.

3. The apparatus of claim 1, wherein the partitioning plate includes a fixing protrusion that is configured to fix or separate the partitioning plate to or from one side of the first panel or one side of the second panel.

4. The apparatus of claim 1, wherein when the partitioning plate is fixed to the first panel or the second panel, a spacing between the partitioning plate and the first panel or the second panel is kept to be constant.

5. The apparatus of claim 1, wherein when the first panel is fixed to the second panel, each of a spacing between the first panel and the partitioning plate and a spacing between the partitioning plate and the second panel is kept to be constant.

6. The apparatus of claim 1, wherein the fixing portion comprises:

a first fixing member disposed on an inner face of the first panel and configured to hold the first laundry; and a second fixing member disposed on an inner face of the second panel and configured to hold the second laundry.

7. The apparatus of claim 1, wherein the second panel is disposed between the first laundry treating chamber and the second laundry treating chamber.

8. The apparatus of claim 6, further comprising:

a first base plate that is disposed on the inner face of the first panel, that is configured to contact the partitioning plate, and that is configured to press the first laundry held by the first fixing member; and a second base plate that is disposed on the inner face of the second panel, that is configured to contact the partitioning plate, and that is configured to press the second laundry held by the second fixing member.

9. The apparatus of claim 7, wherein a communication hole for communicating the first laundry treating chamber and the second laundry treating chamber with each other is defined in the second panel.

10. The apparatus of claim 1, wherein the partitioning plate has a rectangular plate shape, and has an opening defined in a center thereof and extending in a front and rear direction.

11. The apparatus of claim 1, wherein the machine chamber receives therein:

a first laundry treating chamber supply pipe to circulate air in the first laundry treating chamber or to supply steam generated from a steam generator to the first laundry treating chamber; and a second laundry treating chamber supply pipe to supply steam generated from the steam generator to the second laundry treating chamber.

12. The apparatus of claim 11, wherein the second laundry treating chamber supply pipe is a pipe branched from a downstream portion of the first laundry treating chamber supply pipe.

13. The apparatus of claim 12, further comprising an adjustment cover that is configured to control steam supply to the second laundry treating chamber supply pipe, the adjustment cover being disposed at one side of the first laundry treating chamber supply pipe at which the second laundry treating chamber supply pipe is connected to the first laundry treating chamber supply pipe.

14. The apparatus of claim 11, further comprising a laundry treating chamber supply hole that is defined in a top of the machine chamber and that is configured to supply steam flowing in the second laundry treating chamber supply pipe to the door assembly.

15. The apparatus of claim 14, wherein the door assembly has a door inflow hole defined therein for supplying steam discharged from the laundry treating chamber supply hole to the second laundry treating chamber.

16. The apparatus of claim 14, wherein a door inflow hole through which steam flowing through the laundry treating chamber supply hole flows into the second laundry treating chamber is defined in a bottom of the second panel, and wherein a door discharge hole through which steam flowing through the second laundry treating chamber is exhausted to the first laundry treating chamber is defined in a top of the second panel.

17. The apparatus of claim 15, further comprising a door inflow hole-gasket that is disposed on the second panel and that is configured to, based on the door assembly closing the cabinet, cover a space between the door inflow hole and the laundry treating chamber supply hole.

18. The apparatus of claim 1, wherein the door assembly further includes:

a first ironing partitioning portion including:

a first ironing partitioning body pivotably disposed between the first panel and the partitioning plate, and a first heater disposed on at least one of opposing faces of the first ironing partitioning body to apply heat to the laundry; and a second ironing partitioning portion including:

a second ironing partitioning body pivotably disposed between the partitioning plate and the second panel, and a second heater disposed on at least one of both opposing faces of the second ironing partitioning body to apply heat to the laundry.

19. The apparatus of claim 1, wherein the first laundry and the second laundry are at least two separate garments, and wherein the partitioning plate is configured to simultaneously press both of the first laundry and the second laundry.

* * * * *